US007165985B2

(12) United States Patent
Hashiguchi et al.

(10) Patent No.: US 7,165,985 B2
(45) Date of Patent: Jan. 23, 2007

(54) CONNECTOR APPARATUS PROVIDED WITH A LEVER HAVING A ROTATING END USED IN COUPLING OF THE CONNECTOR APPARATUS

(75) Inventors: Osamu Hashiguchi, Tokyo (JP); Kouji Nakada, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/448,638

(22) Filed: Jun. 7, 2006

(65) Prior Publication Data

US 2006/0286833 A1 Dec. 21, 2006

(30) Foreign Application Priority Data

Jun. 7, 2005 (JP) ..... 2005-167372

(51) Int. Cl.
*H01R 13/62* (2006.01)

(52) U.S. Cl. ..... 439/157; 439/152; 439/160

(58) Field of Classification Search ..... 439/725, 439/157, 160, 152, 154, 352
See application file for complete search history.

(56) References Cited

U.S. PATENT DOCUMENTS 5,954,528 A * 9/1999 Ono et al. ..... 439/157
6,164,991 A * 12/2000 Matsuura et al. ..... 439/157
6,276,948 B1 * 8/2001 Okabe ..... 439/157
6,428,353 B1 * 8/2002 Mochizuki ..... 439/545
6,547,574 B1 * 4/2003 Sasaki et al. ..... 439/157

FOREIGN PATENT DOCUMENTS

JP 11102748 4/1999

* cited by examiner

*Primary Examiner*—Michael C. Zarroli
(74) *Attorney, Agent, or Firm*—Collard & Roe, P.C.

(57) ABSTRACT

A connector apparatus includes a first and a second connector connected and disconnected to each other with relative movement in a fitting direction and a separating direction, respectively. In the first connector, a lever member is coupled to a base member and a housing which are relatively movable in the fitting and separating direction. The lever member includes an axis portion rotatably supported by the base member, a first cam portion spaced from the axis portion, and a second cam portion formed at a rotating end. The housing has a first cam-operated portion cooperated with the first cam portion to rotate the lever member following the movement thereof. The second connector has a second cam-operated portion engaged with and separated from the second cam portion following the rotation of the lever member.

11 Claims, 47 Drawing Sheets

CONNECTOR APPARATUS PROVIDED WITH A LEVER HAVING A ROTATING END USED IN COUPLING OF THE CONNECTOR APPARATUS

This application claims priority to prior Japanese patent application JP 2005-167372, the disclosure of which is incorporated herein by reference.

BACKGROUND OF THE INVENTION

This invention relates to a connector apparatus including a pair of connectors connectable to each other and, in particular, to a coupling mechanism for coupling connectors by the use of a lever.

For example, Japanese Unexamined Patent Application Publication (JP-A) No. H11-102748 discloses a connector apparatus comprising a female connector and a male connector which are fitted and connected to each other. The connector apparatus has a coupling mechanism for coupling housings of the female and the male connectors to each other upon connecting the female and the male connectors. The coupling mechanism comprises a frame, a lever, and a pushing/engaging portion formed on the housing of the male connector. The frame is movable in a fitting direction with respect to the housing of the male connector. The lever has one end rotatably supported by the frame. The lever has the other end protruding obliquely forward from a connecting end of the housing of the male connector. The pushing/engaging portion is engaged with an intermediate portion of the lever. The housing of the female connector has a through hole to receive the lever inserted therethrough.

The above-mentioned coupling mechanism does not have a positioning mechanism for the lever. Before fitting, the lever protrudes outward from the connecting end of the housing of the male connector. After fitting, the lever protrudes outward via the through hole of the housing of the female connector. Therefore, when the female and the male connectors are assembled, when the female and the male connectors are fitted to each other, and after the female and the male connectors are fitted, the lever may possibly be broken.

SUMMARY OF THE INVENTION

It is therefore an object of this invention to provide a connector apparatus capable of controlling a position of a lever used in a coupling mechanism to prevent the lever from protruding outward.

It is another object of this invention to provide a connector apparatus which is high in reliability of connection and which requires only a small force for connection.

Other objects of the present invention will become clear as the description proceeds.

According to an aspect of the present invention, there is provided a connector apparatus comprising a first and a second connector which are adapted to be connected to each other with relative movement in a fitting direction and to be disconnected from each other with relative movement in a separating direction opposite to the fitting direction, wherein the first connector comprises a base member, a housing held by the base member to be movable in the fitting direction and in the separating direction, and a lever member coupled to the base member and the housing, the lever member comprising an axis portion rotatably supported by the base member, a first cam portion spaced from the axis portion and faced to the housing, and a second cam portion formed at a rotating end, the housing having a first cam-operated portion which is cooperated with the first cam portion to rotate the lever member with respect to the axis portion following the movement of the housing, the second connector having a second cam-operated portion which is adapted to be engaged with the second cam portion in the separating direction, the second cam-operated portion being engaged with and separated from the second cam portion following the rotation of the lever member.

DESCRIPTION OF THE PREFERRED EMBODIMENTS

Figure 1:
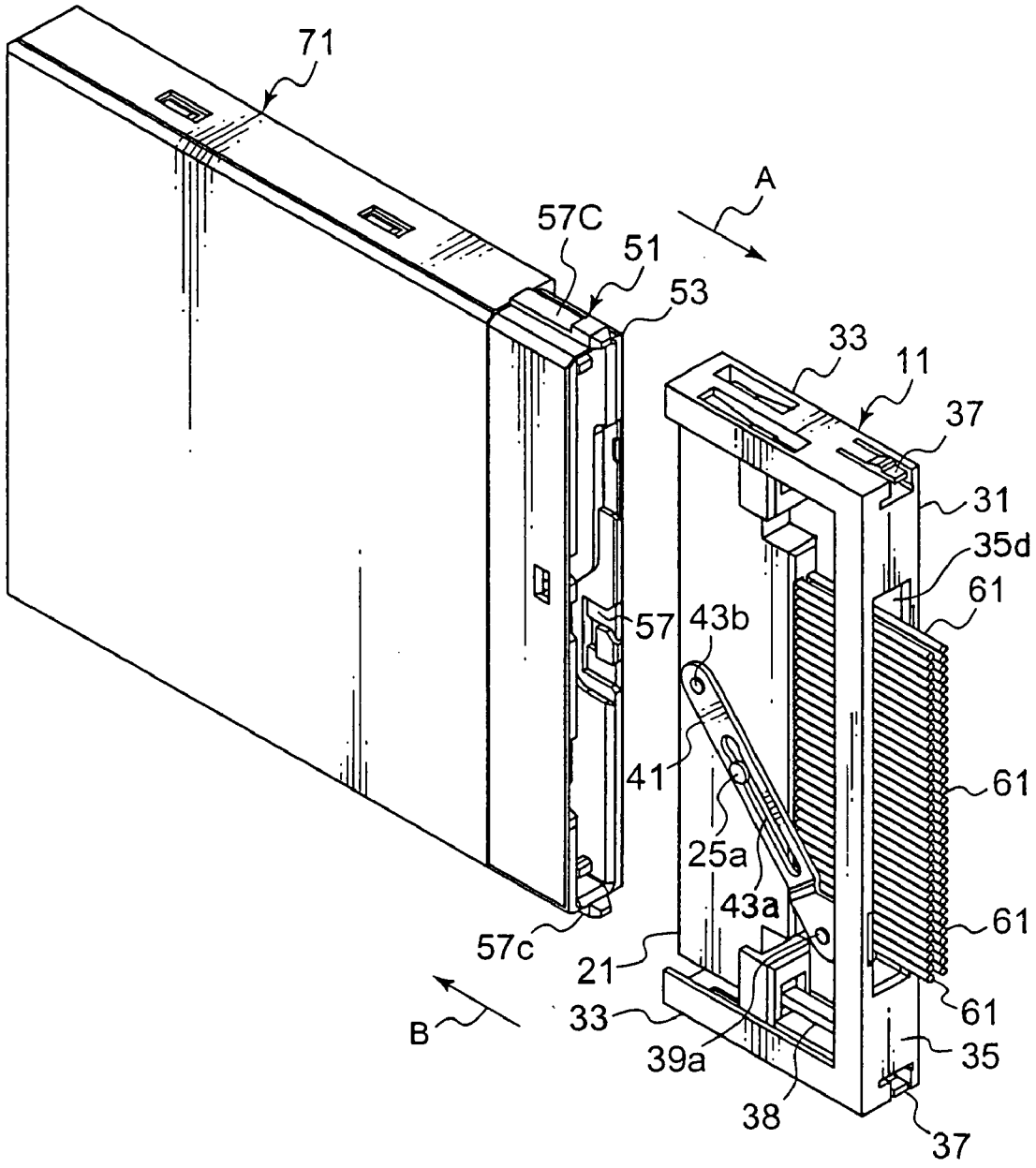
FIG. 1 is a perspective view of a connector apparatus according to a first embodiment of this invention in a state before connection, the connector apparatus including a first connector with cables connected thereto, a second connector adapted to be fitted to the first connector, and a lever member for coupling the first and second connectors to each other.
Figure 59:
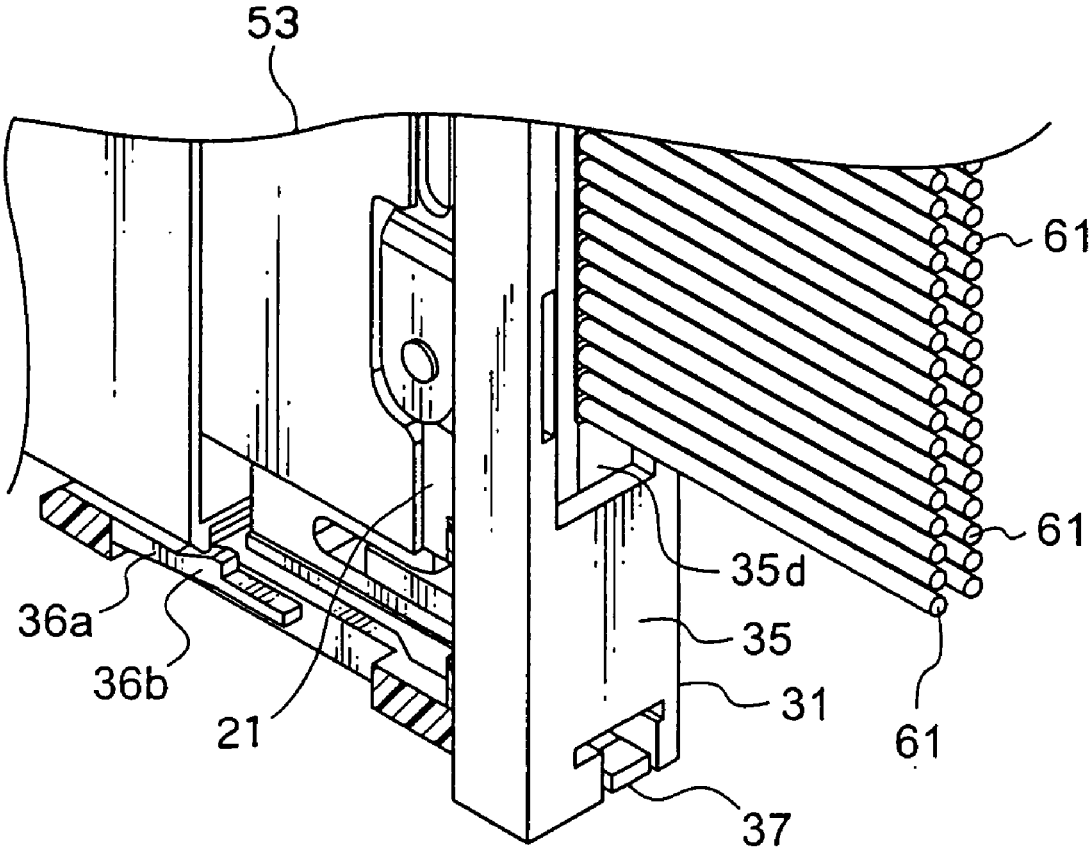
FIG. 59 is an enlarged sectional perspective view similar to FIG. 58 as seen in a different direction.

Referring to FIGS. 1 through 59, description will be made of a connector apparatus according to a first embodiment of this invention.

Figure 2:
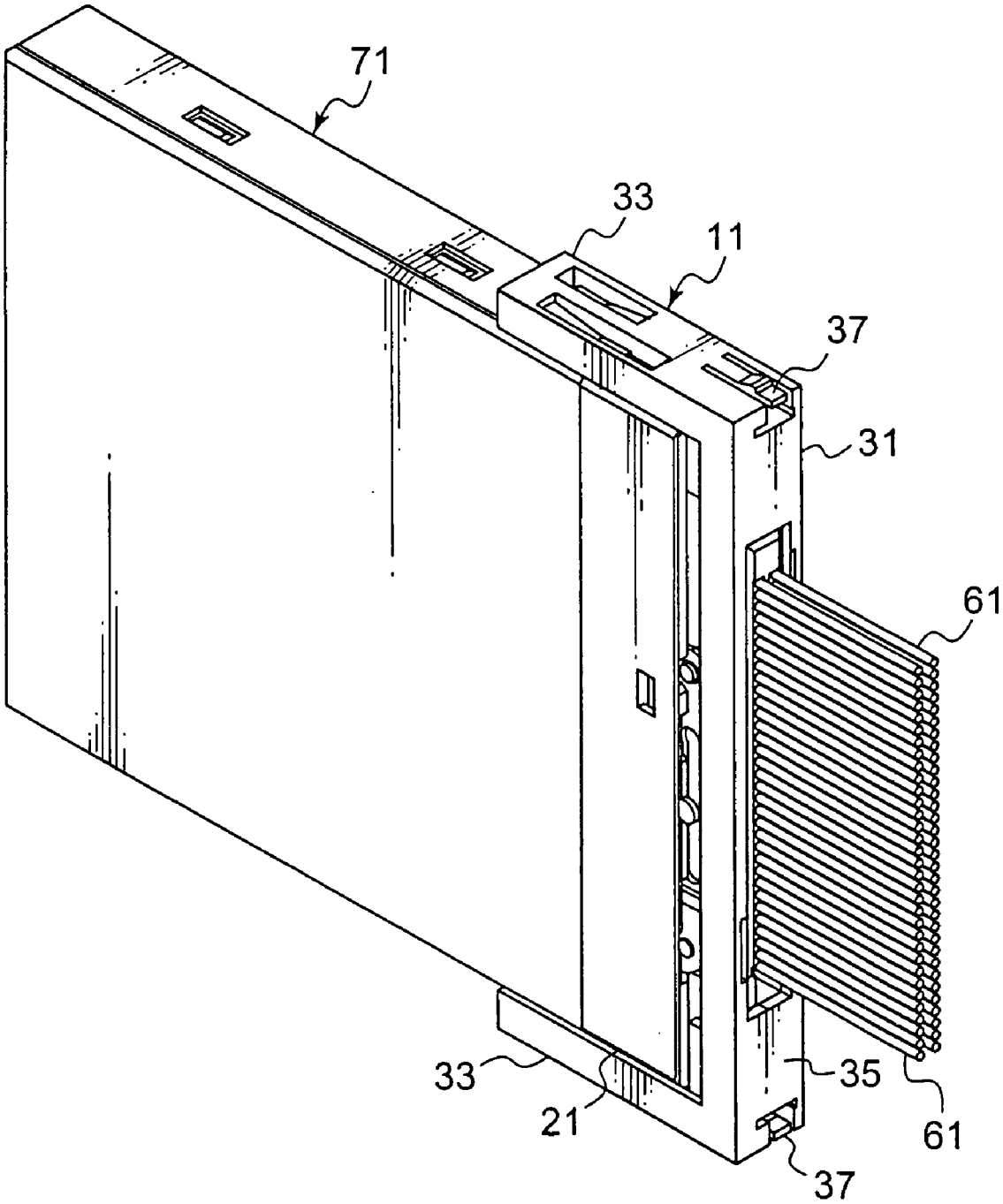
FIG. 2 is a perspective view of the connector apparatus in FIG. 1 in a state after connection.
Figure 3:
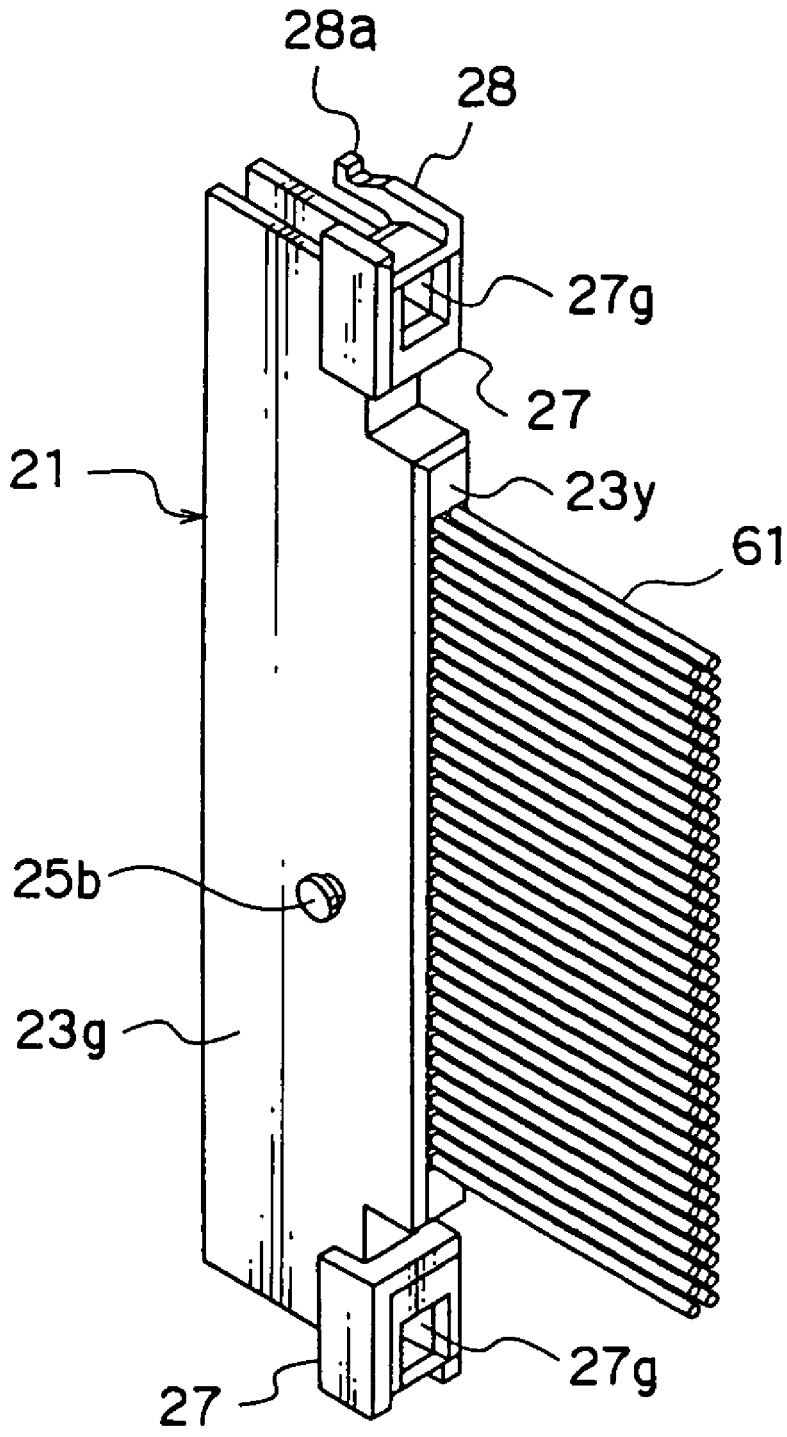
FIG. 3 is a perspective view showing a housing included in the first connector, together with the cables as seen from one surface.
Figure 4:
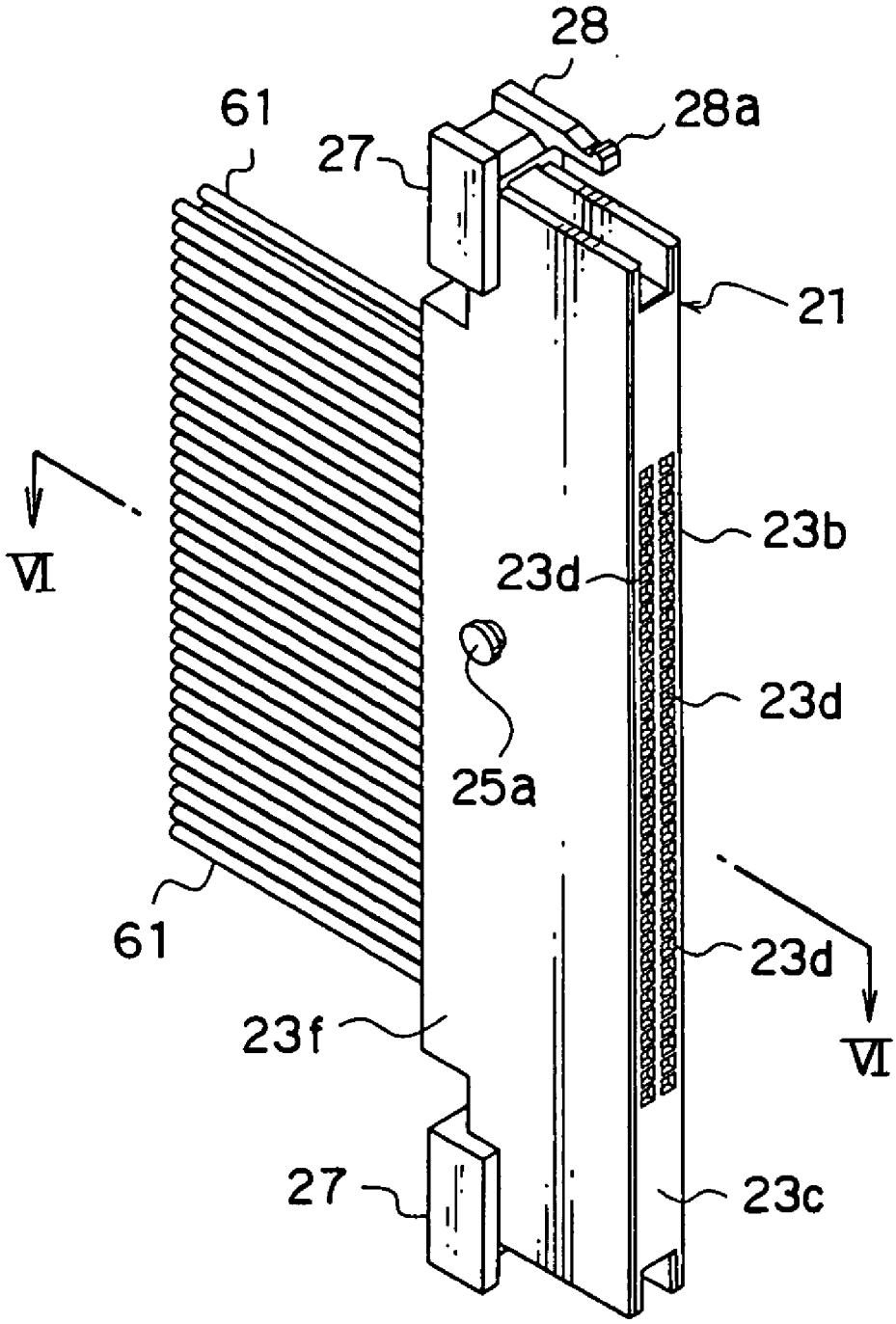
FIG. 4 is a perspective view showing the housing together with the cables as seen from the opposite surface.
Figure 5:
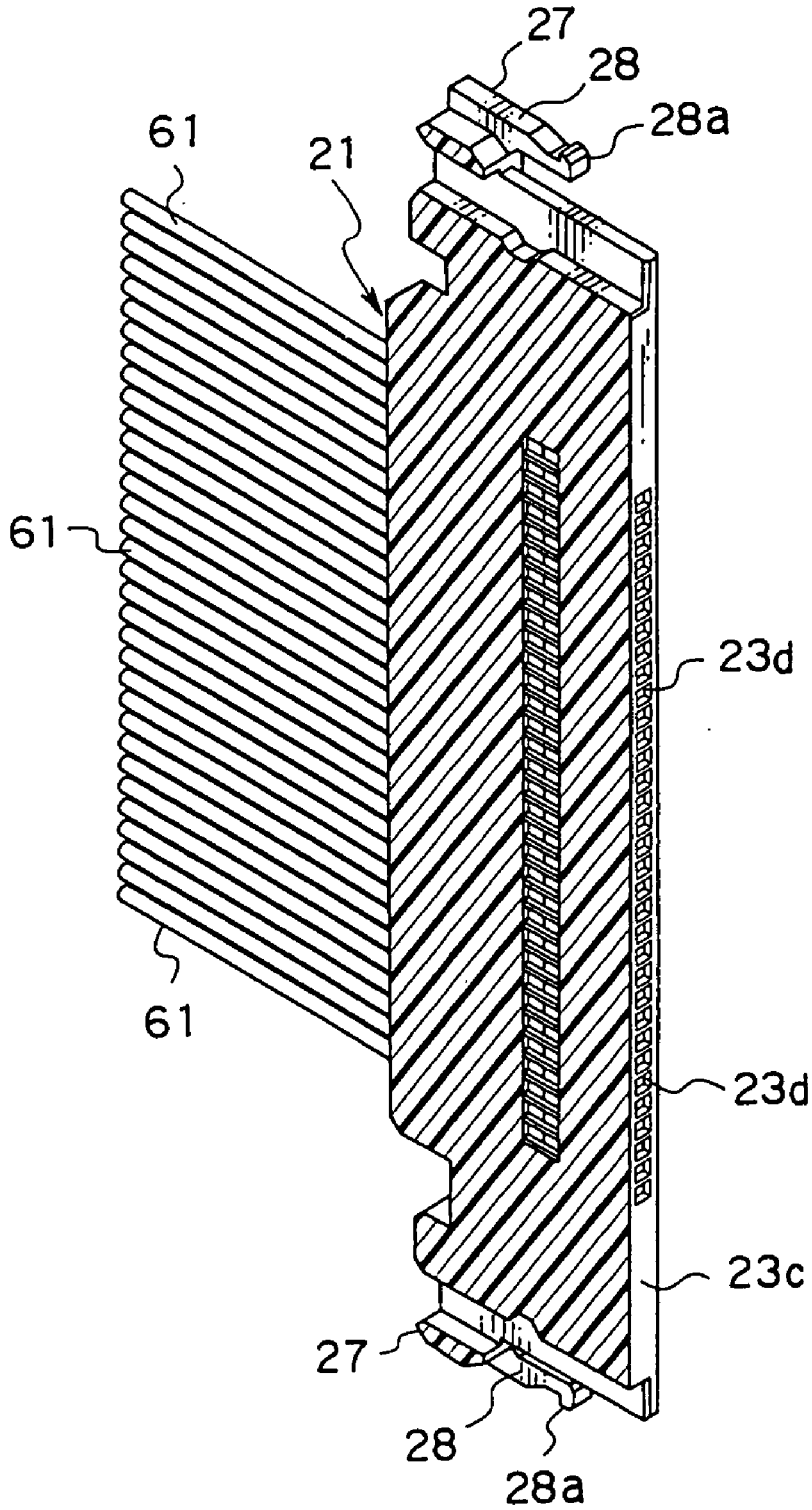
FIG. 5 is a sectional perspective view showing the housing of FIG. 4 together with the cables.
Figure 6:
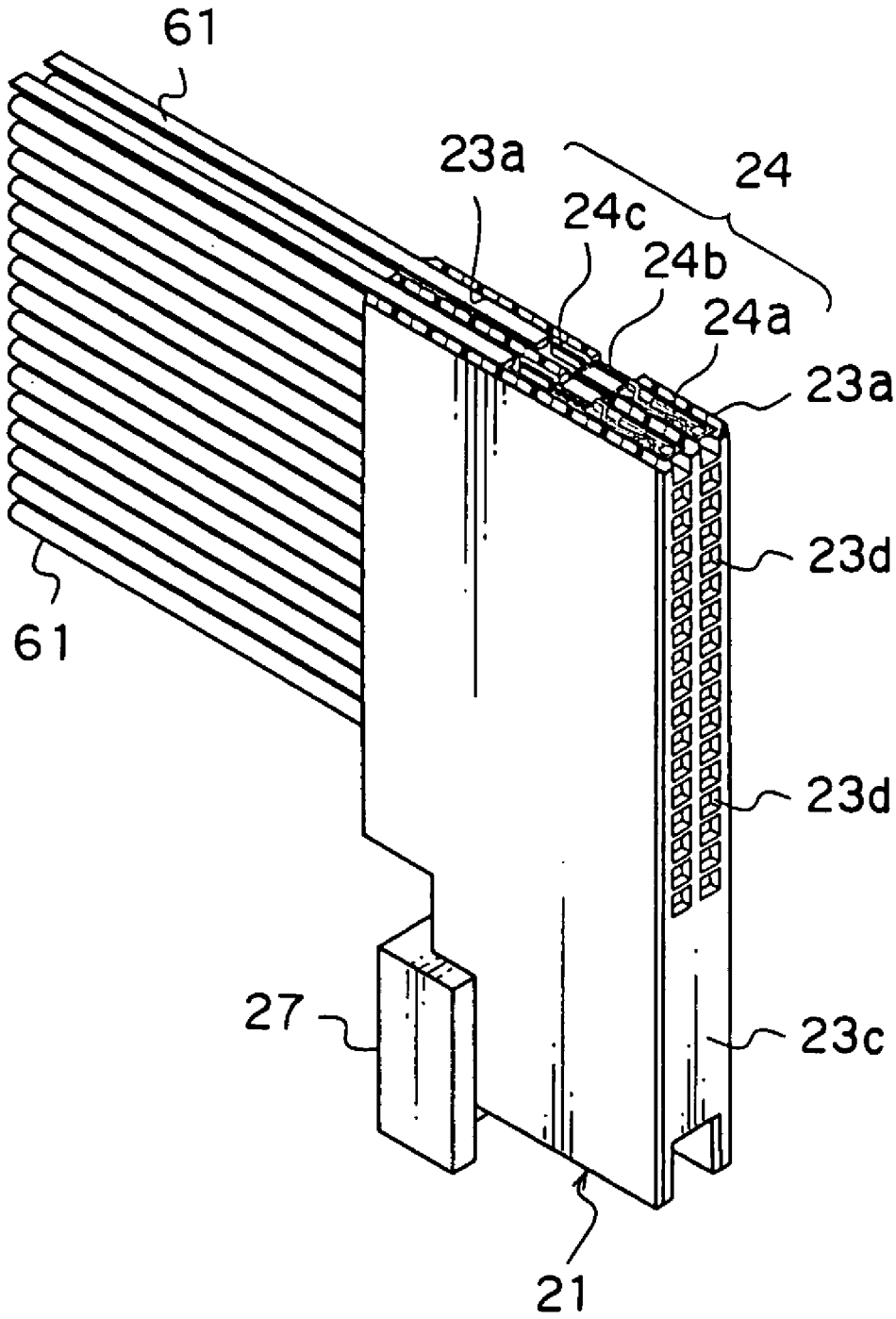
FIG. 6 is a sectional perspective view taken along a line VI—VI in FIG. 4.
Figure 7:
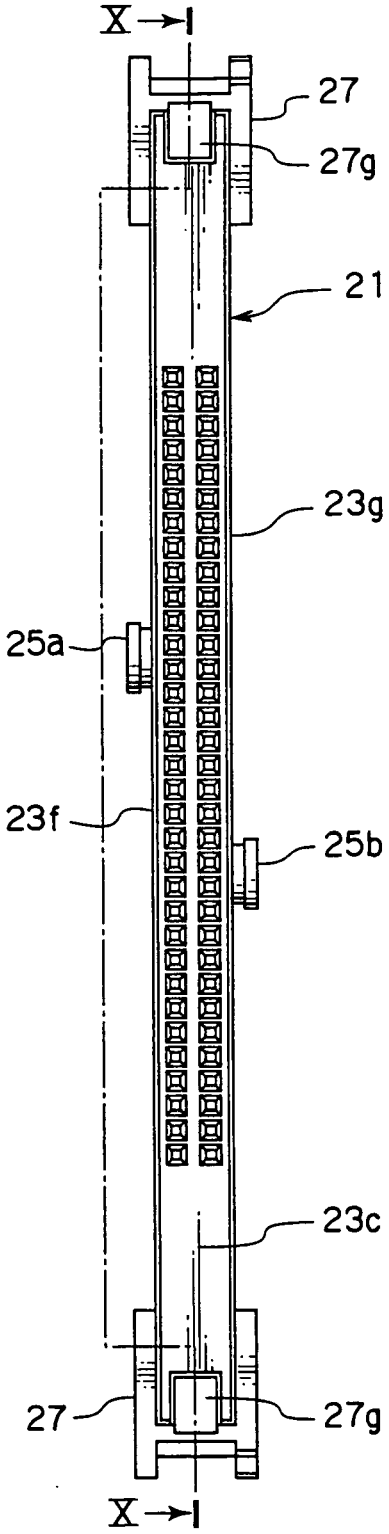
FIG. 7 is a front view of the housing.
Figure 8:
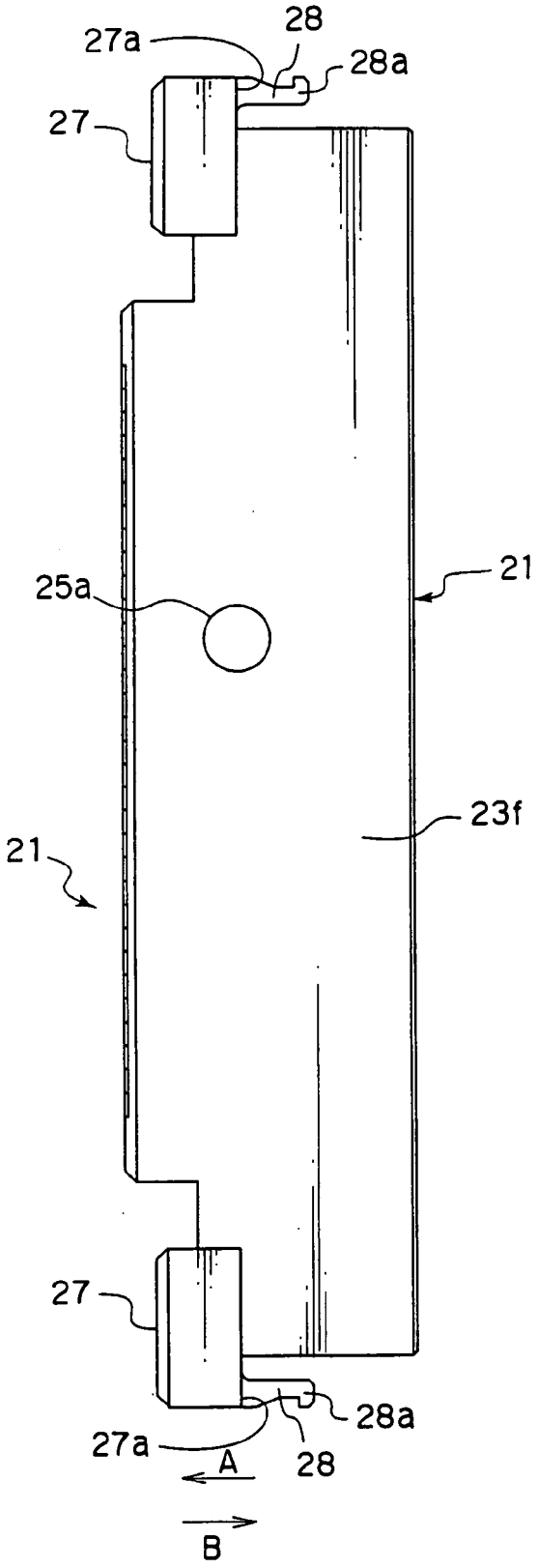
FIG. 8 is a left side view of the housing.
Figure 9:
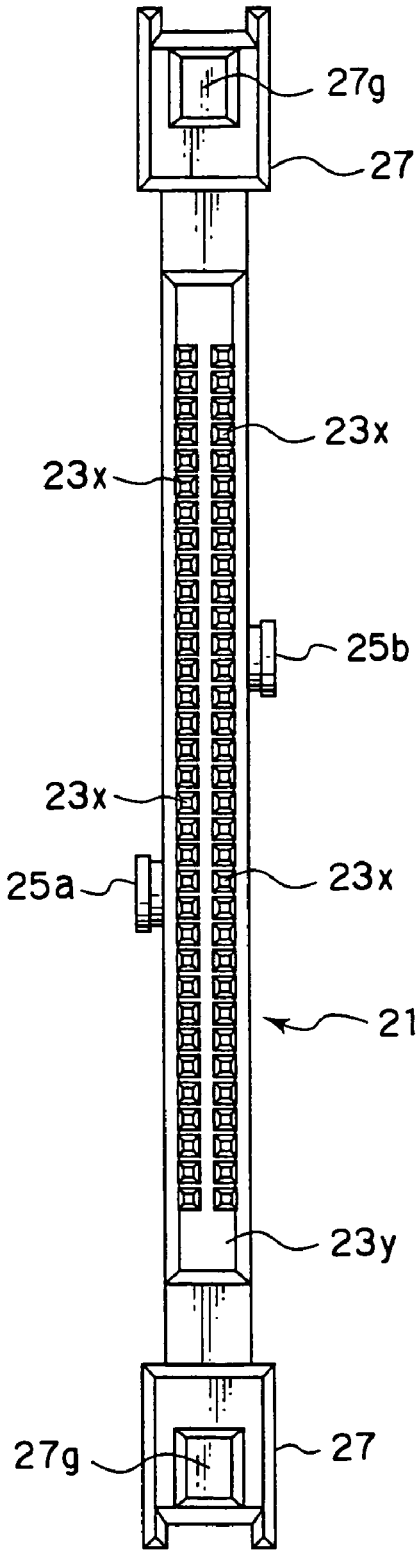
FIG. 9 is a rear view of the housing.

FIGS. 1 and 2 show a whole of the connector apparatus. The connector apparatus illustrated in the figures comprises a first connector 11 and a second connector 51 as a mating connector to be connected to the first connector 11. In the following description, it is assumed that the first connector 11 is stationary and that the second connector 51 is movable in a fitting direction A and a separating direction B opposite to the fitting direction A.

At first, the first connector 11 will be described. The first connector 11 comprises an insulating housing 21 of a rectangular parallelepiped shape or a generally long plate-like shape, an insulating base member 31 holding the housing 21 so that the housing 21 is slidable in the fitting direction A and the separating direction B, and a pair of lever members 41 (only one being illustrated in FIG. 1) connecting the housing 21 and the base member 31. It is to be noted that one of the lever members 41 is placed at one side of the first connector 11 and that another of the lever members 41 is placed at the opposite side of the first connector 11.

As shown in FIGS. 3 through 6 also, the housing 21 is formed by molding a resin material. Inside the housing 21, a plurality of receiving portions 23*a* (see FIG. 6) are formed. In the receiving portions 23*a*, a plurality of conductive contacts 24 are received in one-to-one correspondence. The housing 21 has a fitting portion 23*b* formed at its end in the separating direction B. The fitting portion 23*b* has a fitting surface 23*c* provided with a plurality of insertion holes 23*d* communicating with the receiving portions 23*a*.

The contacts 24 are connected to a plurality of cables 61 in the receiving portions 23*a* of the housing 21. The cables 61 are led out through a plurality of cable insertion holes 23*x* formed on a rear end surface 23*y* of the housing 21. Each of the contacts 24 has a socket portion 24*a* to be connected to a mating contact (not shown) of the second connector 51 when the mating contact is inserted through the insertion hole 23*d*, a holding portion 24*b* held by the housing 21, and a terminal portion 24*c* connected to a core wire of the cable 61.

Referring to FIGS. 7 through 11 in addition, the housing 21 has a top surface 23*f* perpendicular to the fitting surface 23*c* and provided with a first cam-operated portion 25*a*. The first cam-operated portion 25*a* is formed in the shape of a protrusion. The first cam-operated portion 25*a* serves to rotatably support the lever member 41 (FIG. 1).

The housing 21 has a bottom surface 23*g* perpendicular to the fitting surface 23*c* and provided with a first cam-operated portion 25*b*. The first cam-operated portion 25*b* is also formed in the shape of a protrusion and serves to rotatably support another lever member (not shown) same in shape as the lever member 41. On the housing 21, the first cam-operated portions 25*a* and 25*b* are positioned offset from each other in a longitudinal direction.

The housing 21 has a pair of block portions 27 formed at opposite ends in the longitudinal direction and at one end in the fitting direction A. Each of the block portions 27 has a first positioning portion 27*a* on an end face facing the separating direction B and a second positioning portion 28 extending from the first positioning portion 27*a* in the separating direction B. The second positioning portion 28 has a free end provided with a claw portion 28*a* slightly protruding outward.

Figure 10:
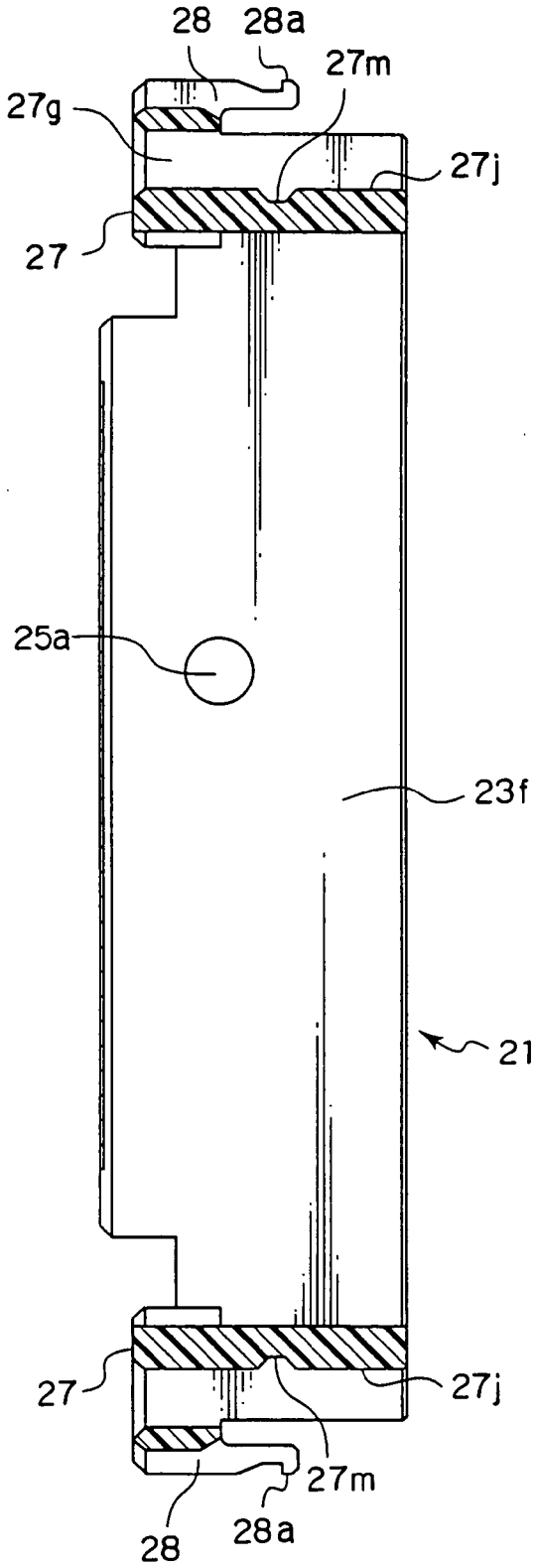
FIG. 10 is a sectional view taken along a line X—X in FIG. 7.
Figure 11:
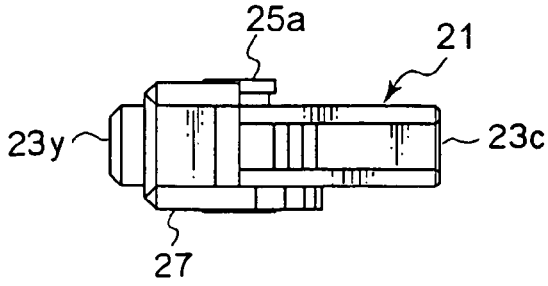
FIG. 11 is a plan view of the housing.

Each of the block portions 27 has a through hole 27*g* extending between its end faces in the fitting direction A and the separating direction B. As shown in FIG. 10, the through hole 27*g* has an inner wall surface 27*j* provided with a recess 27*m*.

Figure 12:
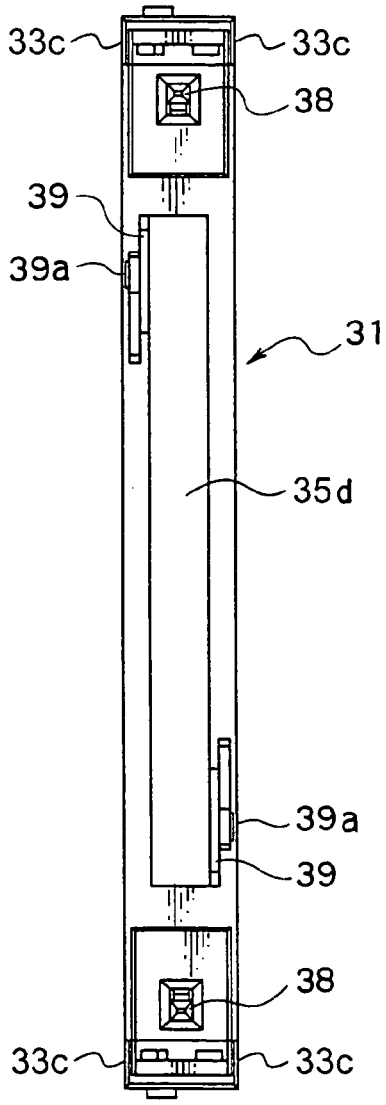
FIG. 12 is a front view of a base member included in the first connector.
Figure 13:
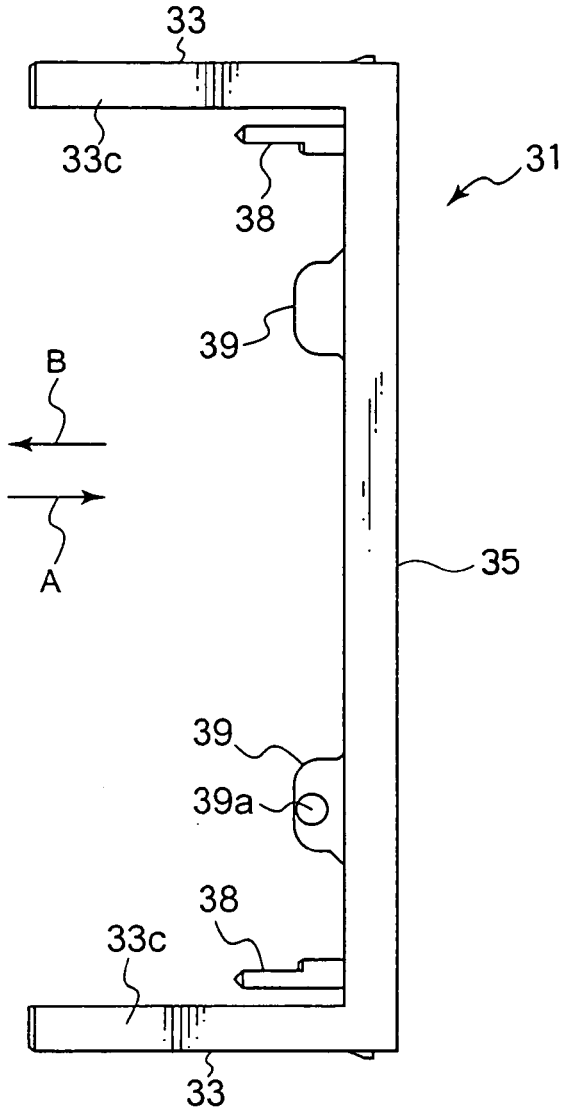
FIG. 13 is a right side view of the base member.
Figure 14:
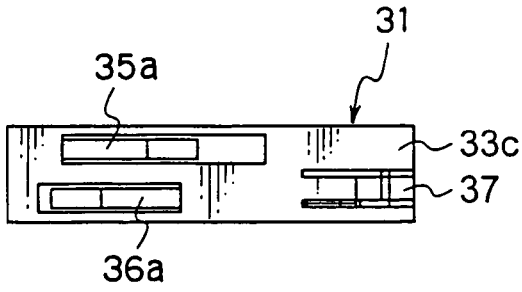
FIG. 14 is a plan view of the base member.
Figure 15:
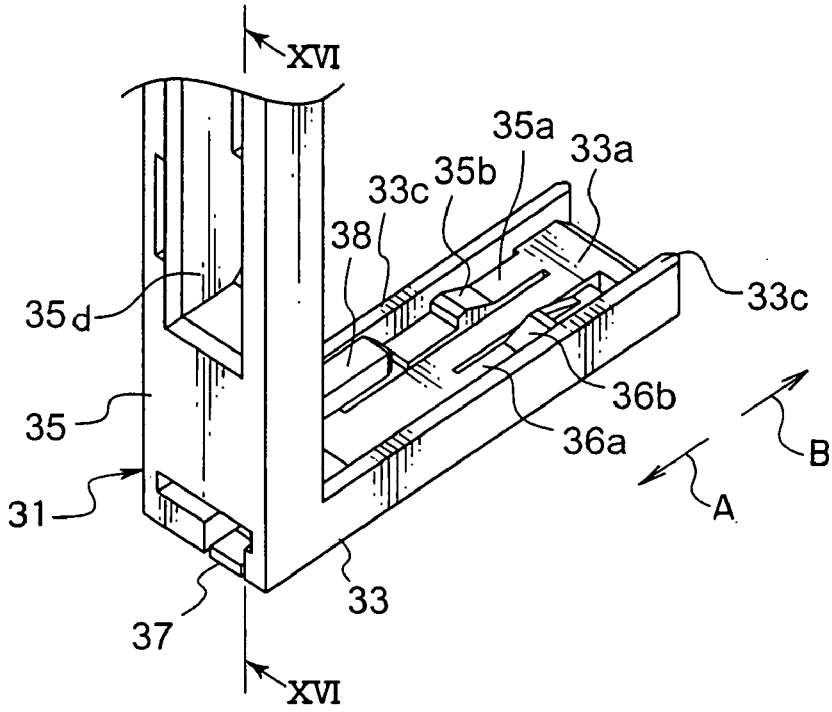
FIG. 15 is a perspective view of a part of the base member.
Figure 16:
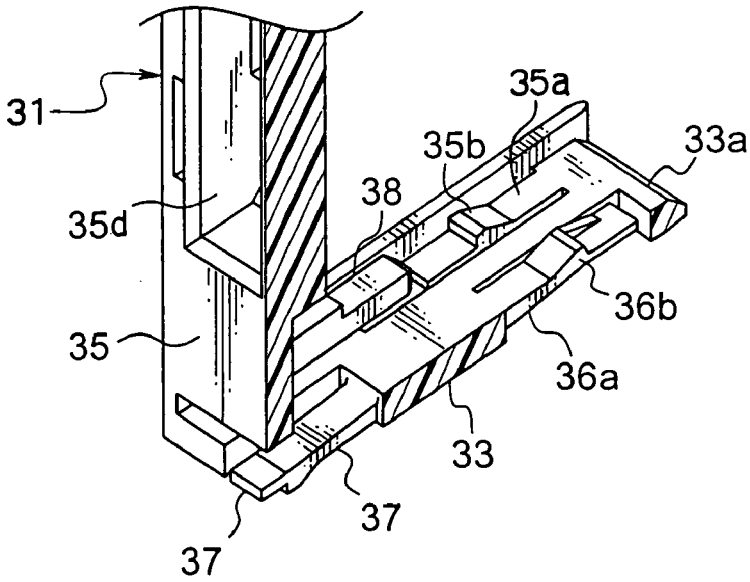
FIG. 16 is a sectional perspective view taken along a line XVI—XVI in FIG. 15.

The base member 31 is produced by molding a resin material and has a generally U shape as shown in FIG. 12. Specifically, as shown in FIGS. 12 through 16, the base member 31 has a pair of frame portions 33 of a long plate-like shape as a whole parallel to each other, and a base portion 35 connecting one ends of the frame portions 33. The frame portions 33 extend from the base portion 35 in the separating direction B in parallel to each other.

Each frame portion 33 has a frame plate portion 33*a* and a pair of wall portions 33*c* standing from longitudinal opposite sides of the frame plate portion 33*a* and faced to each other. The frame plate portion 33*a* is provided with a first positioning spring portion 35*a* extending in the fitting direction A from a position near a longitudinal end and a second positioning spring portion 36*a* extending in the separating direction B from a longitudinal intermediate portion. The first positioning spring portion 35*a* has a first engaging portion 35*b* formed at its intermediate portion. The first positioning spring portion 35*a* serves to position the housing 21. The second positioning spring portion 36*a* has a second engaging portion 36*b* formed at its intermediate portion. The frame portion 33 has a fixed spring portion 37 formed near its end in the fitting direction A to position and fix a module which will later be described in conjunction with FIGS. 60–62.

The base portion 35 has a large window portion 35*a* formed at its intermediate portion and extending in a longitudinal direction. The cables 61 are inserted through the window portion 35*d*. The base portion 35 is provided with a pair of lock bar portions 38 formed adjacent to the frame plate portions 33*a* and a pair of bearing plate portions 39 formed between the lock bar portions 38. The lock bar portions 38 are received in the through holes 27*g* of the housing 21, respectively.

The bearing plate portions 39 are provided with bearing portions 39*a*, respectively. By the use of the bearing portions 39*a*, the two lever members 41 are rotatably attached to the base portion 35. The housing 21 is positioned or locked for the base member 31 by a locking structure (not shown).

Figure 17:
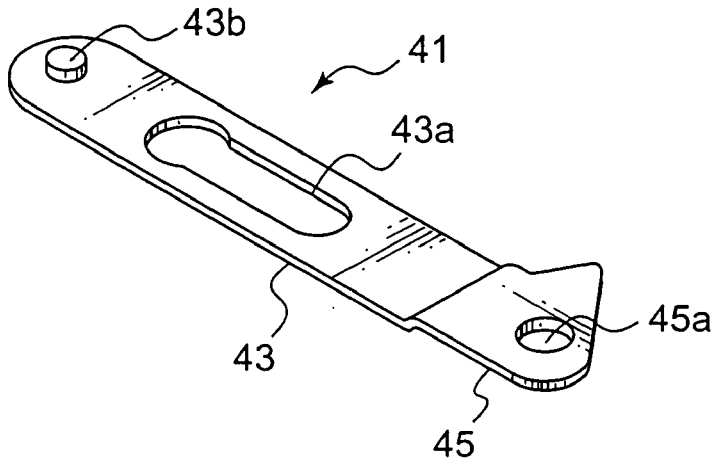
FIG. 17 is a perspective view of the lever member.
Figure 18:
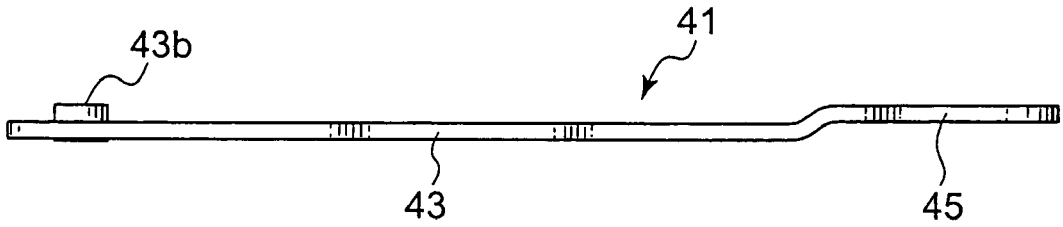
FIG. 18 is a front view of the lever member.
Figure 19:
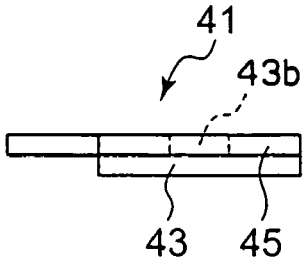
FIG. 19 is a left side view of the lever member.
Figure 20:
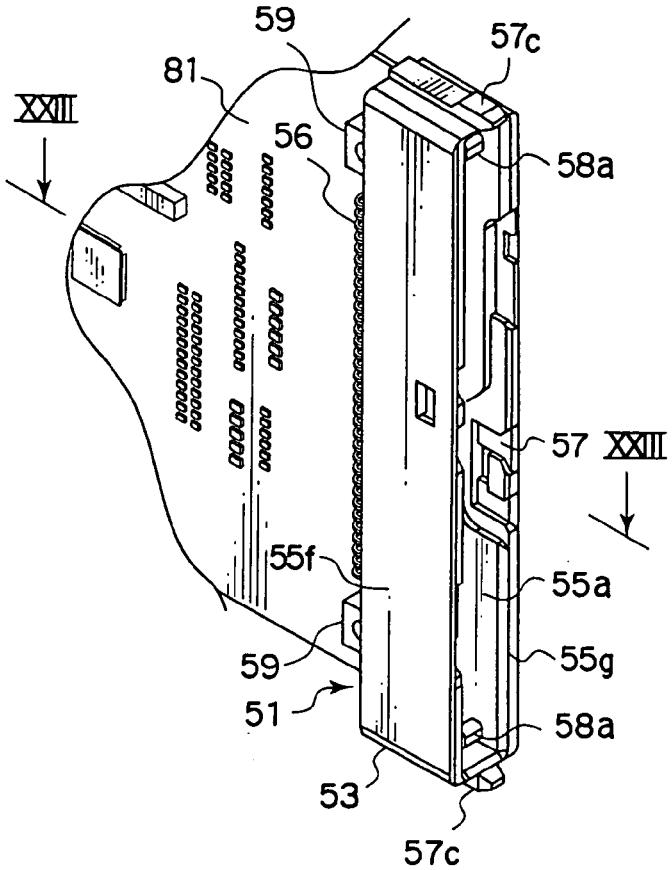
FIG. 20 is a perspective view of the second connector attached to a circuit board.
Figure 21:
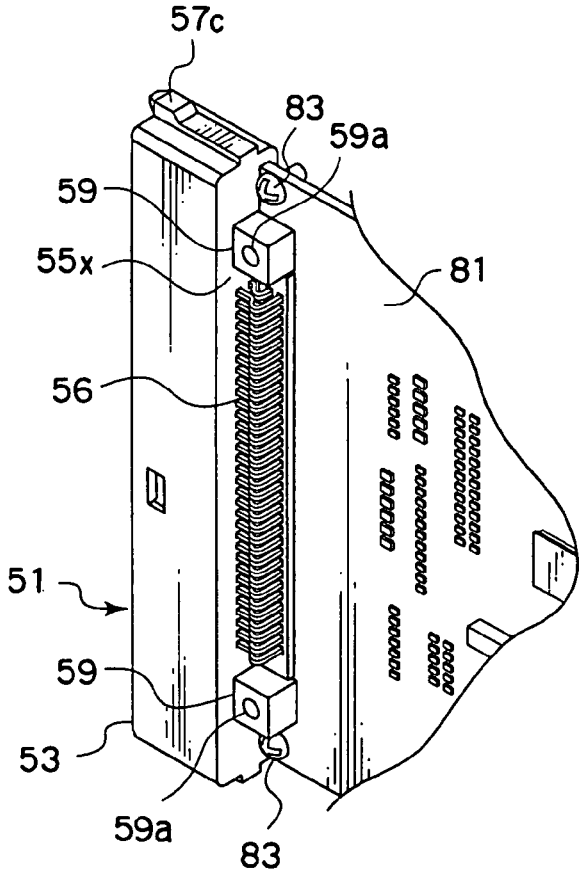
FIG. 21 is a perspective view of the second connector in FIG. 20 as seen in a different direction.
Figure 22:
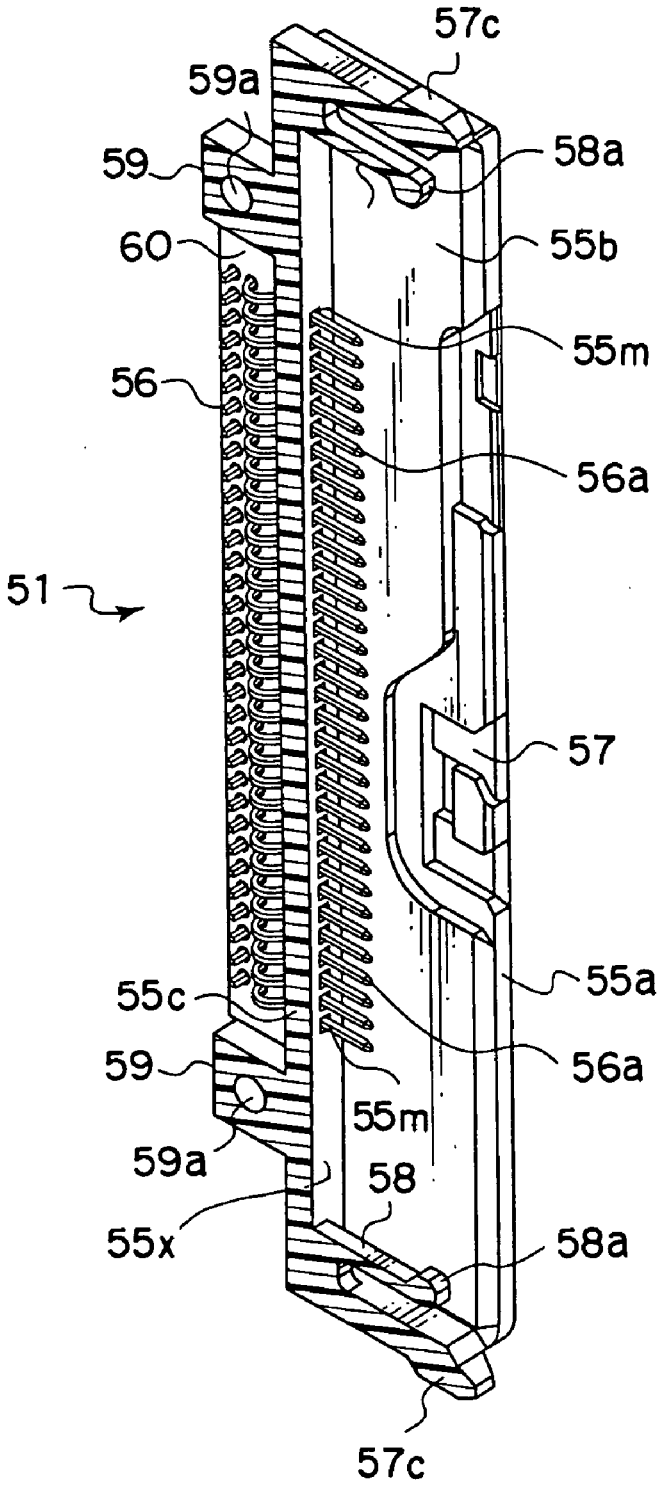
FIG. 22 is a sectional perspective view of the second connector.
Figure 23:
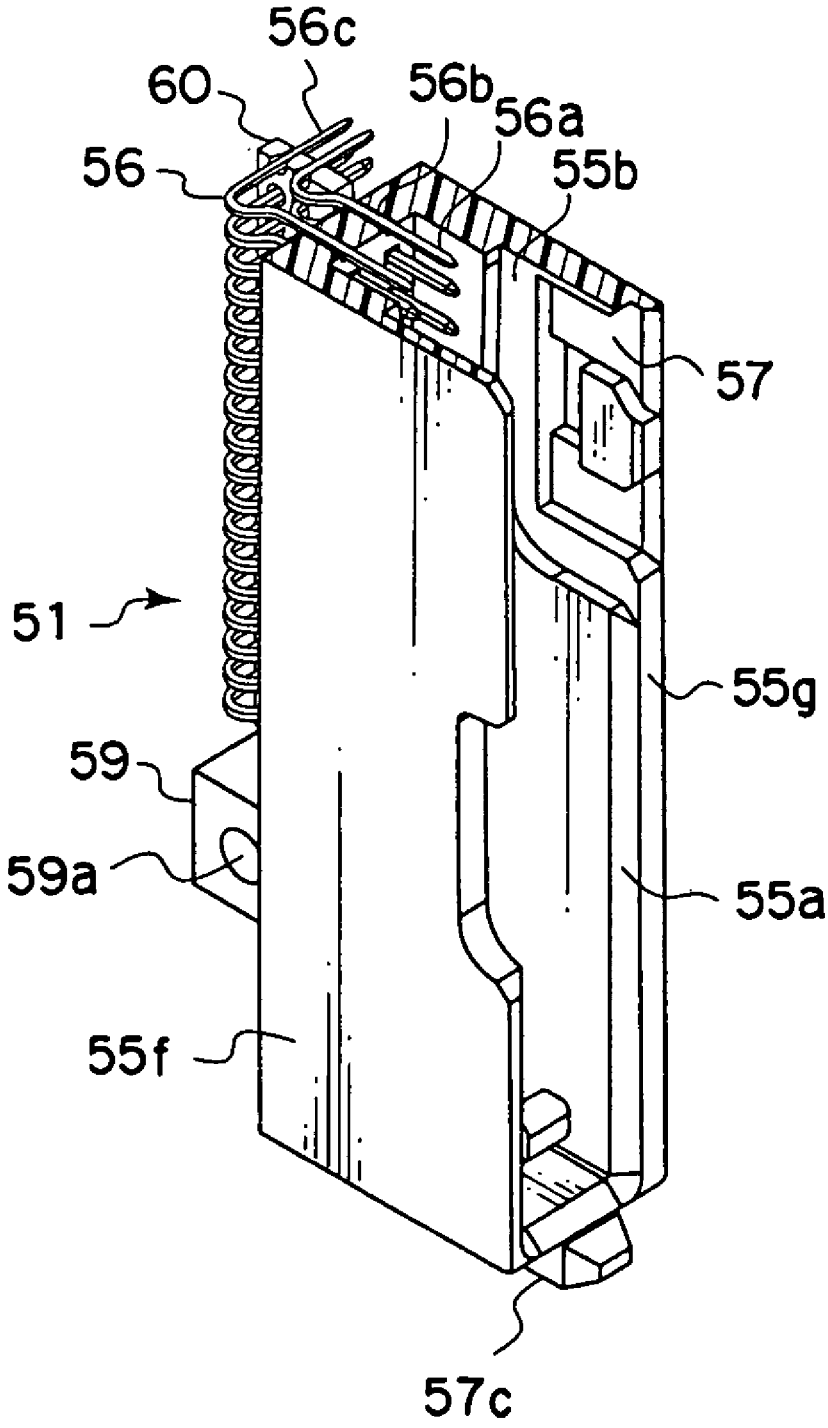
FIG. 23 is a sectional perspective view taken along a line XXIII—XXIII in FIG. 20.

Each lever member 41 is formed by a resin material or a metal plate. As illustrated in FIGS. 17 through 19 also, the lever member 41 has a first lever plate portion 43 of a long plate-like shape and a second lever plate portion 45 formed at one end of the first lever plate portion 43.

The first lever plate portion 43 and the second lever plate portion 45 are different in level from each other with a step formed therebetween. The first lever plate portion 43 has a first cam portion 43*a* formed at its center as a long hole extending in its longitudinal direction. The first lever plate portion 43 has the other end provided with a second cam portion 43*b* protruding on one surface of the first lever plate portion 43. The second lever plate portion 45 has an axis portion 45*a* in the shape of a circular hole rotatably supported on the base member 31.

The first cam portion 43*a* of one of the lever members 41 is a portion engaged with the first cam-operated portion 25*a* of the first connector 11. The first cam portion 43*a* of the other lever member 41 is a portion engaged with the first cam-operated portion 25*b* of the first connector 11.

Next, the second connector 51 or the mating connector will be described. The second connector 51 is mounted to a unit 71 illustrated in FIGS. 1 and 2. As shown in FIGS. 20 through 23 also, the second connector 51 has a housing 53. The housing 53 is fixed to a circuit board 81. The housing 53 holds a plurality of contacts 56 such as pin contacts.

Figure 24:
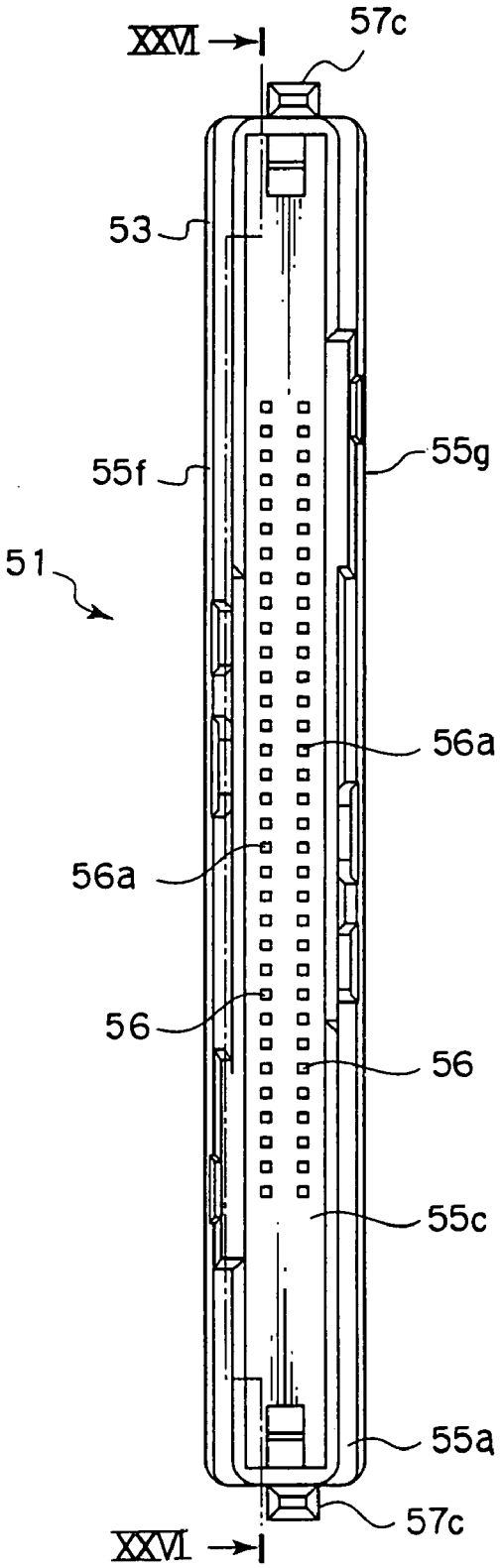
FIG. 24 is a front view of the second connector.
Figure 25:
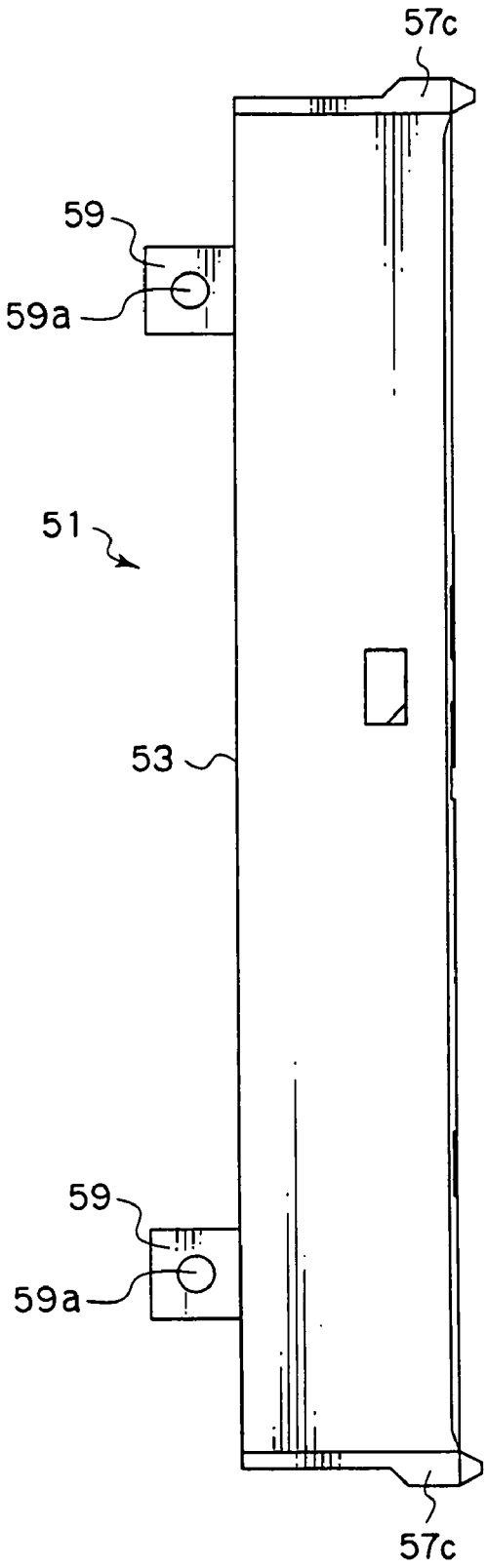
FIG. 25 is a left side view of the second connector.
Figure 26:
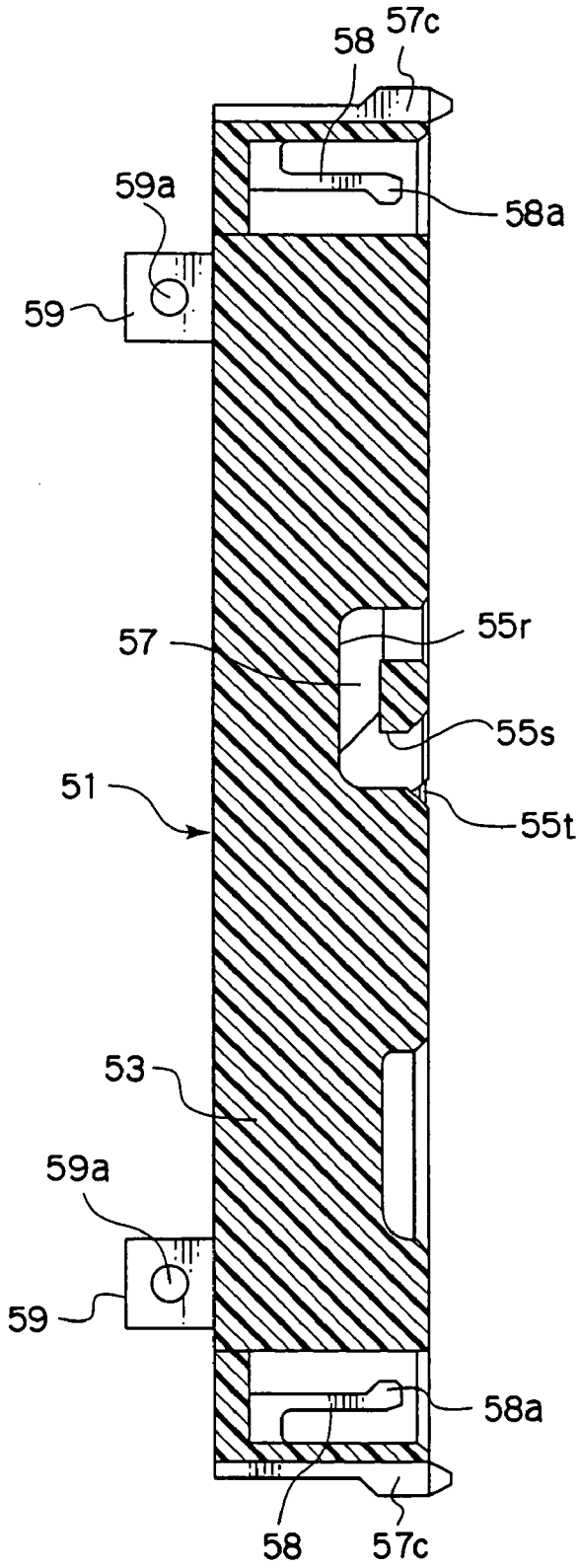
FIG. 26 is a sectional view taken along a line XXVI—XXVI in FIG. 24.
Figure 27:
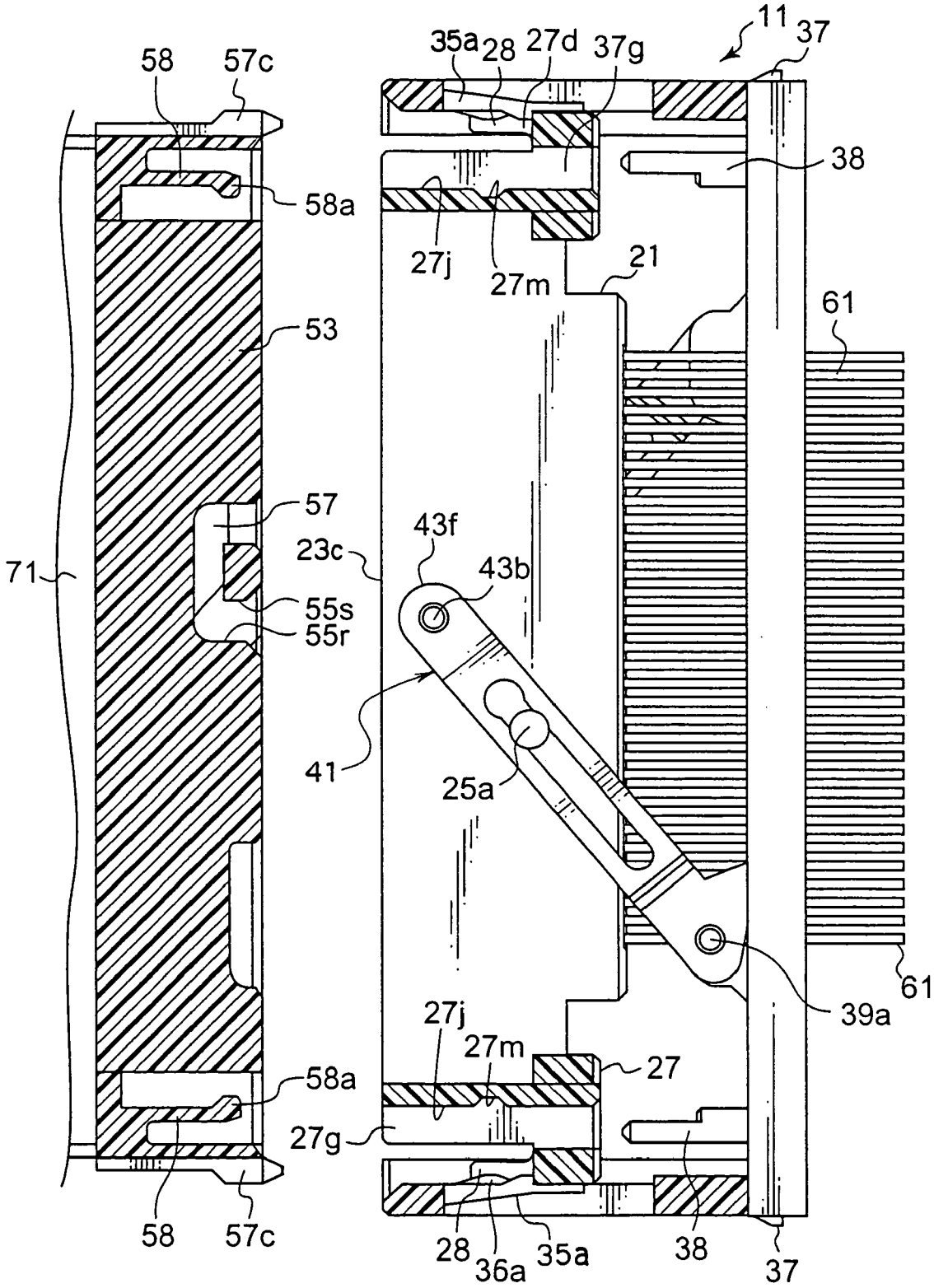
FIG. 27 is a sectional side view of the connector apparatus in FIG. 1 in the state before connection.
Figure 28:
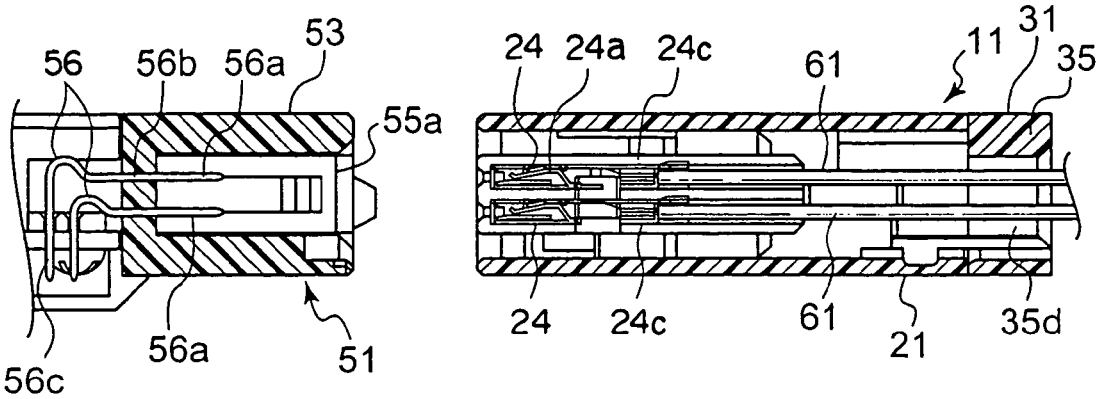
FIG. 28 is a sectional plan view of the connector apparatus in FIG. 27.
Figure 29:
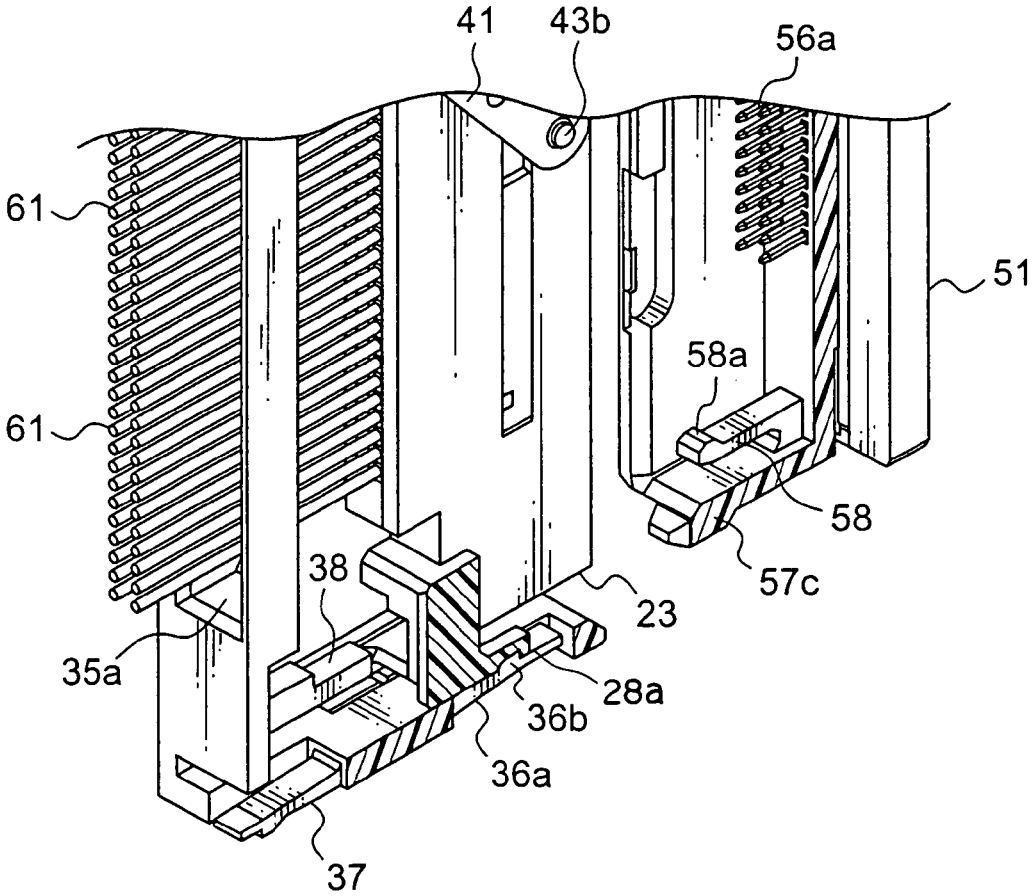
FIG. 29 is an enlarged sectional perspective view of a part of the connector apparatus in FIG. 27.
Figure 30:
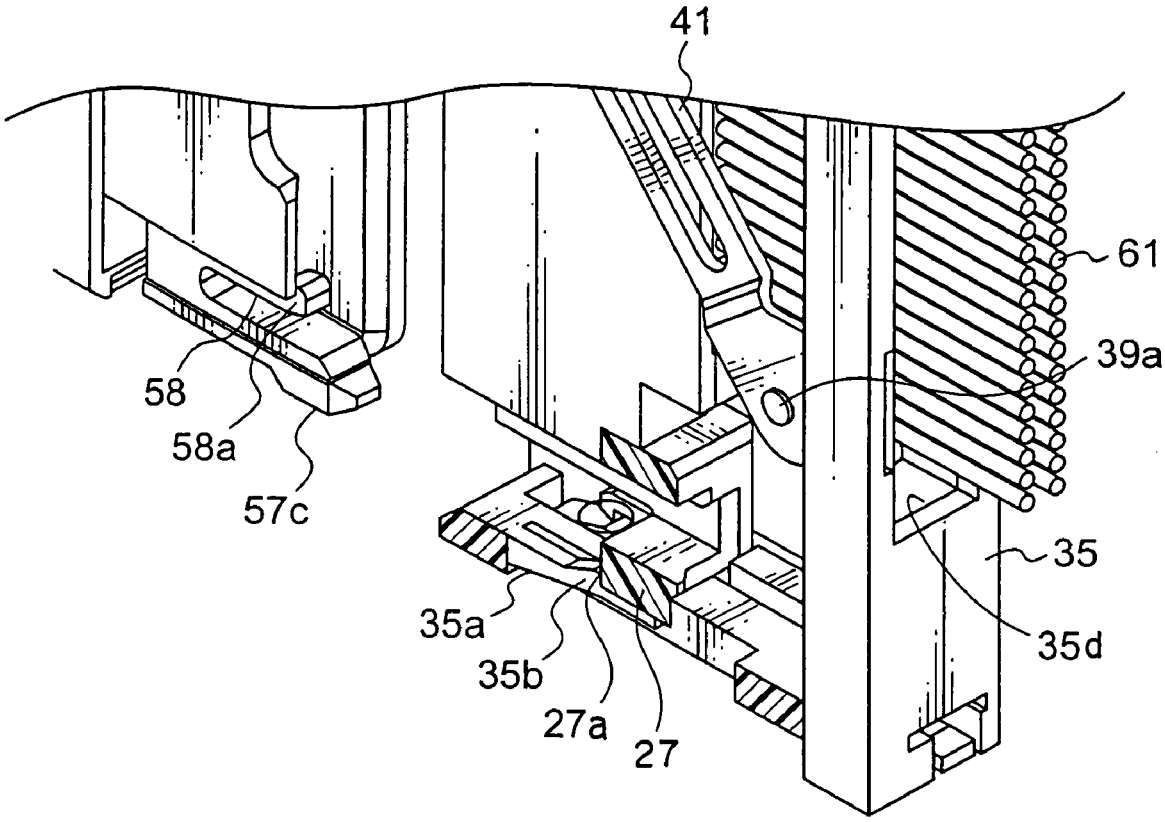
FIG. 30 is an enlarged sectional perspective view similar to FIG. 29 as seen in a different direction.
Figure 31:
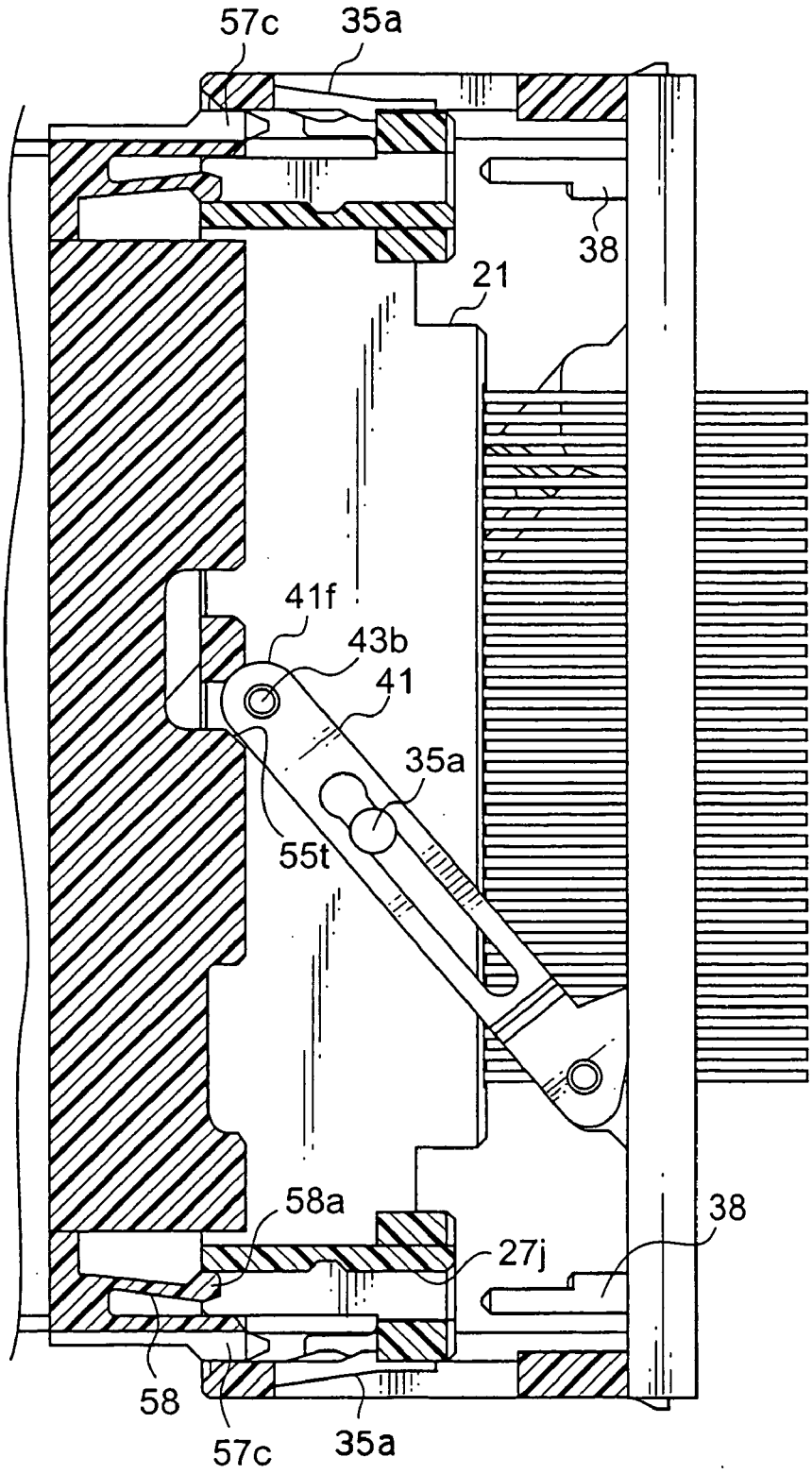
FIG. 31 is sectional side view of the connector apparatus in FIG. 1 in a first state during connection.
Figure 32:
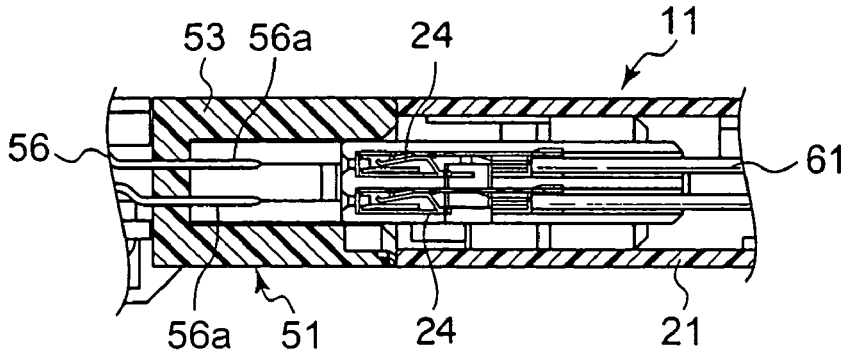
FIG. 32 is a sectional plan view of the connector apparatus in FIG. 31.
Figure 33:
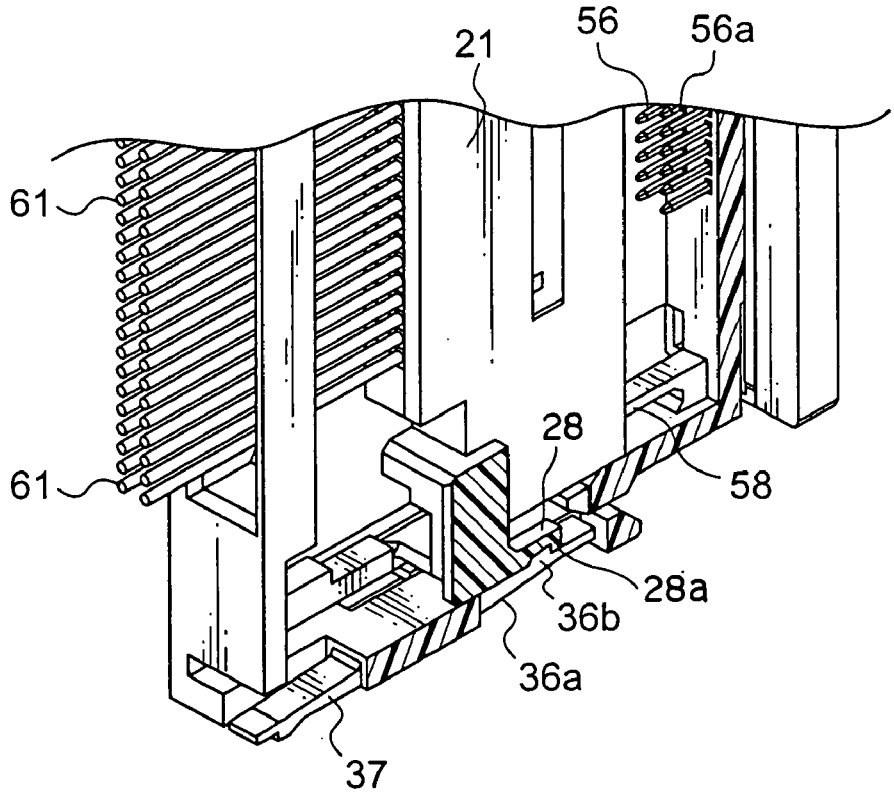
FIG. 33 is an enlarged sectional perspective view of a part of the connector apparatus in FIG. 31.
Figure 34:
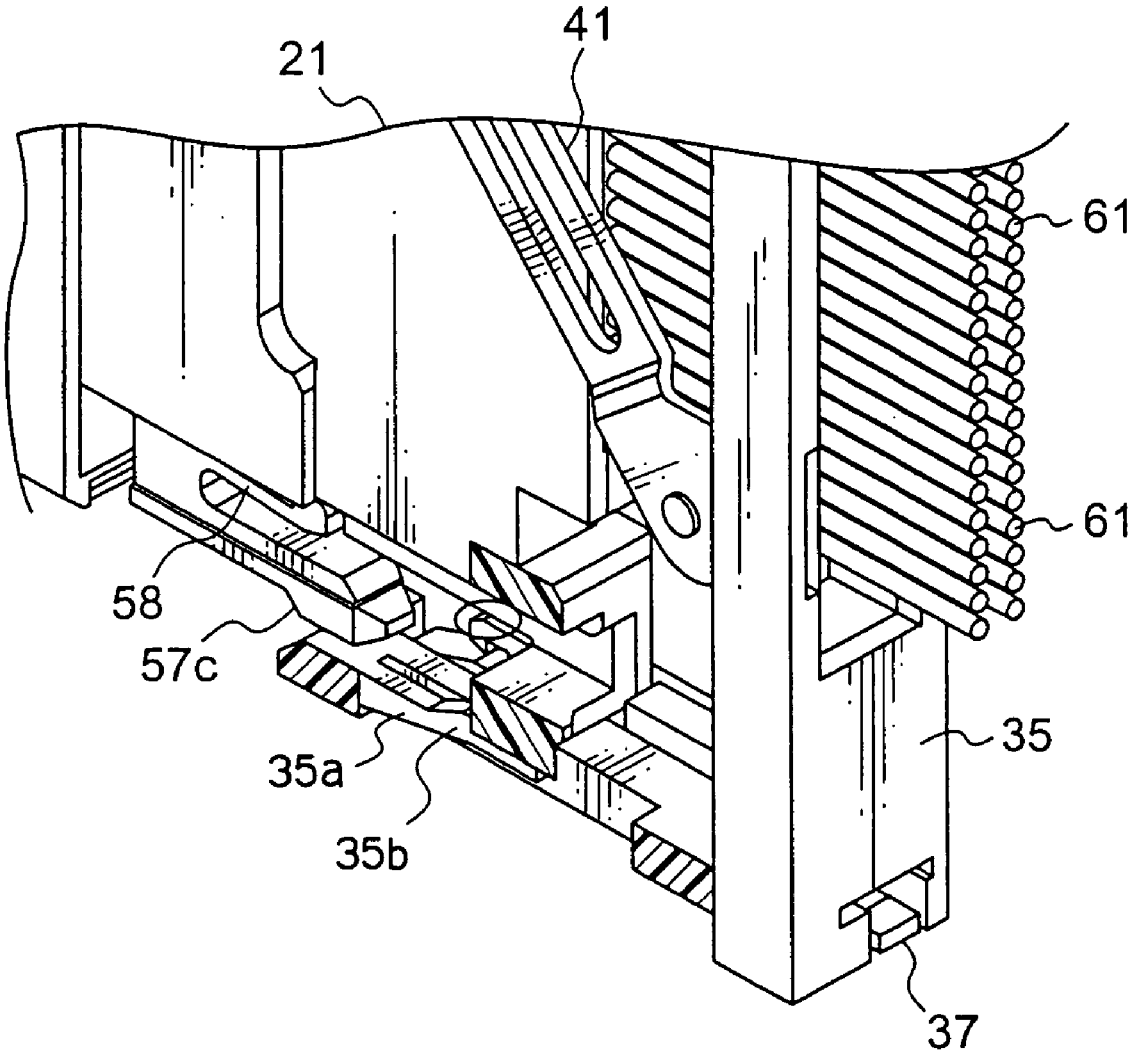
FIG. 34 is an enlarged sectional perspective view similar to FIG. 33 as seen in a different direction.
Figure 35:
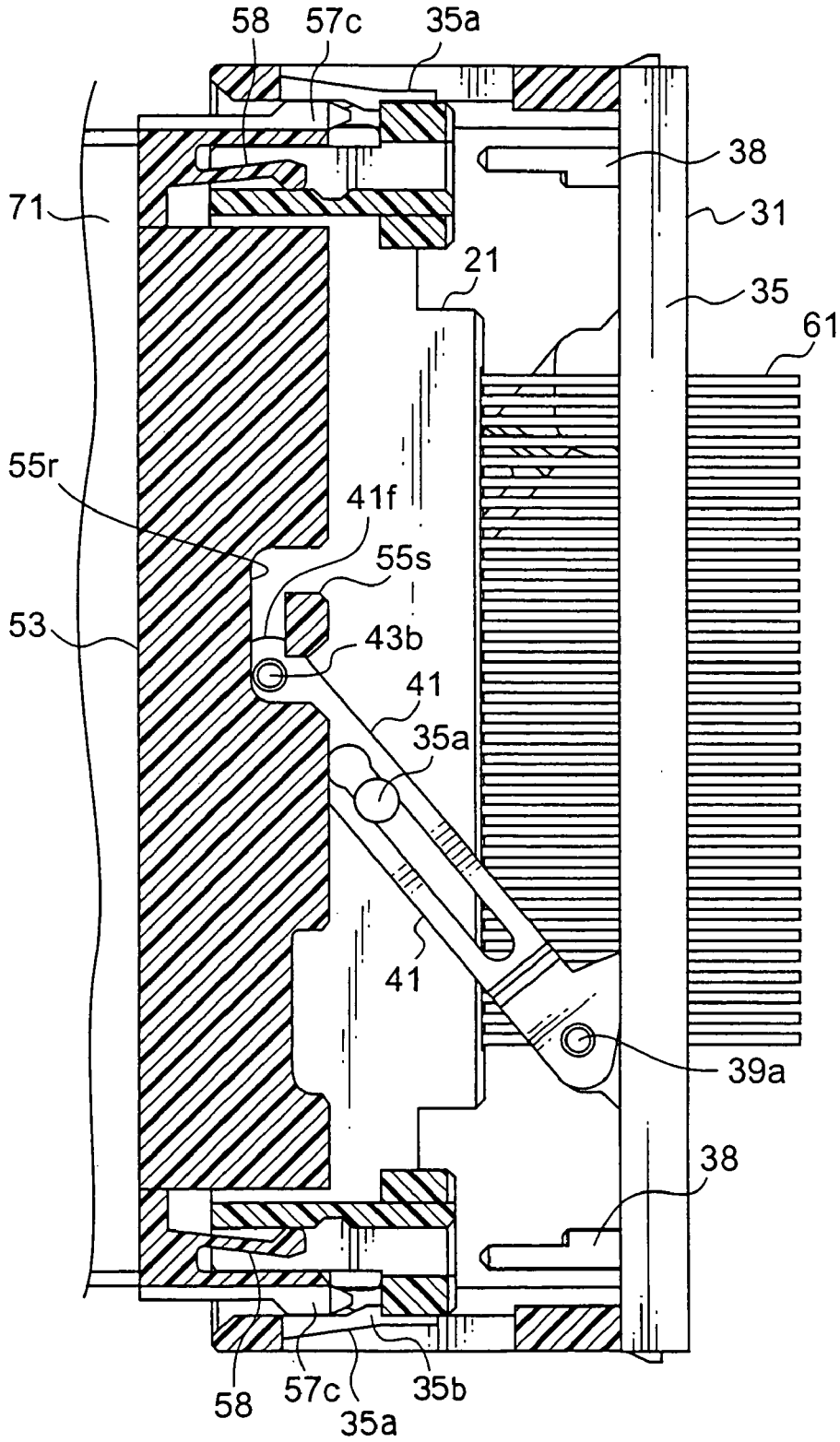
FIG. 35 is a sectional side view of the connector apparatus in FIG. 1 in a second state during connection.
Figure 36:
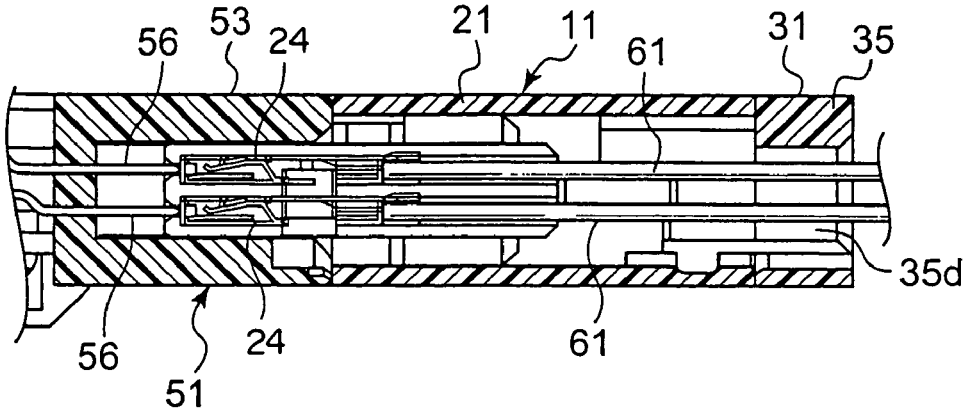
FIG. 36 is a sectional plan view of the connector apparatus in FIG. 35.
Figure 37:
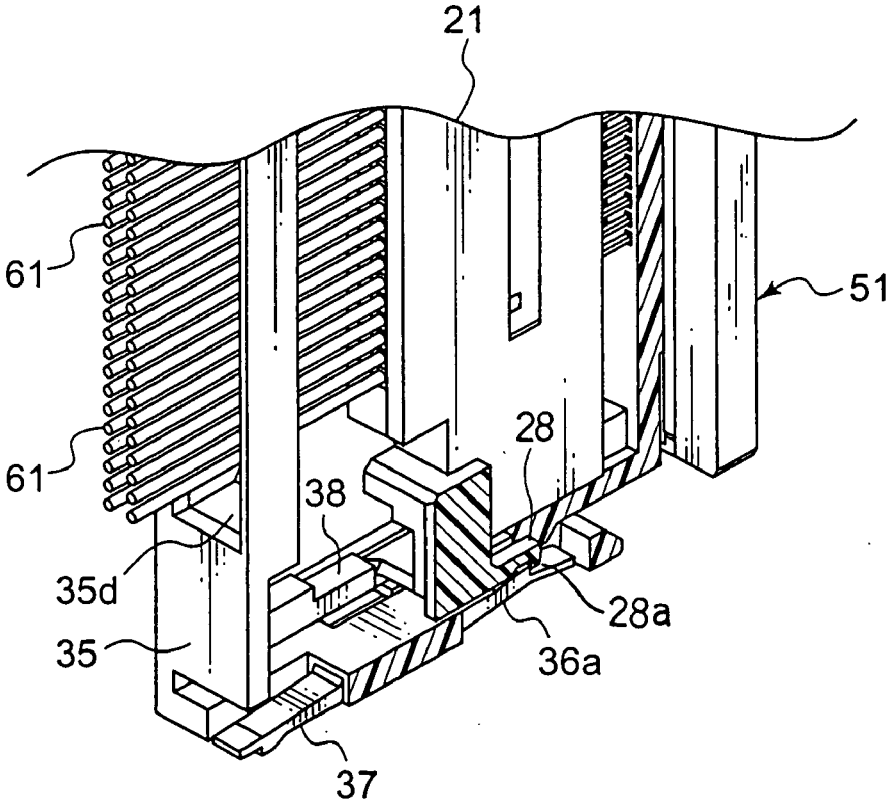
FIG. 37 is an enlarged sectional perspective view of a part of the connector apparatus in FIG. 35.
Figure 38:
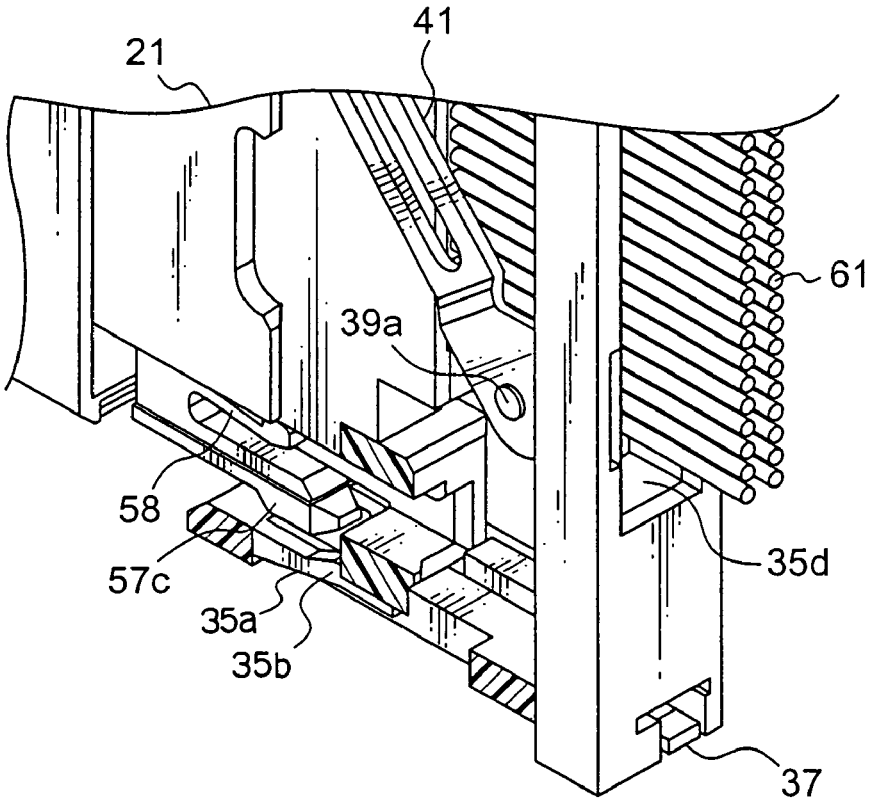
FIG. 38 is an enlarged sectional perspective view similar to FIG. 37 as seen in a different direction.
Figure 39:
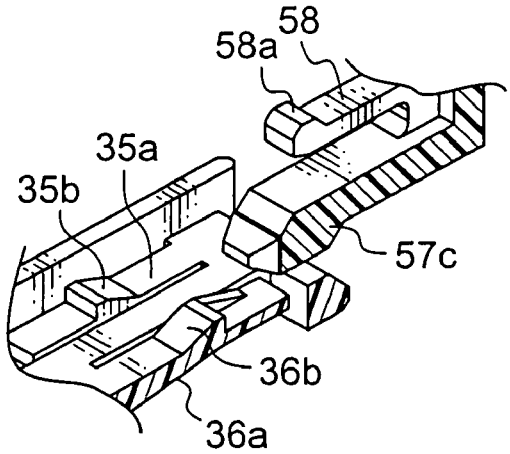
FIG. 39 is an enlarged sectional perspective view of only a part of FIG. 38 as seen in a different direction.
Figure 40:
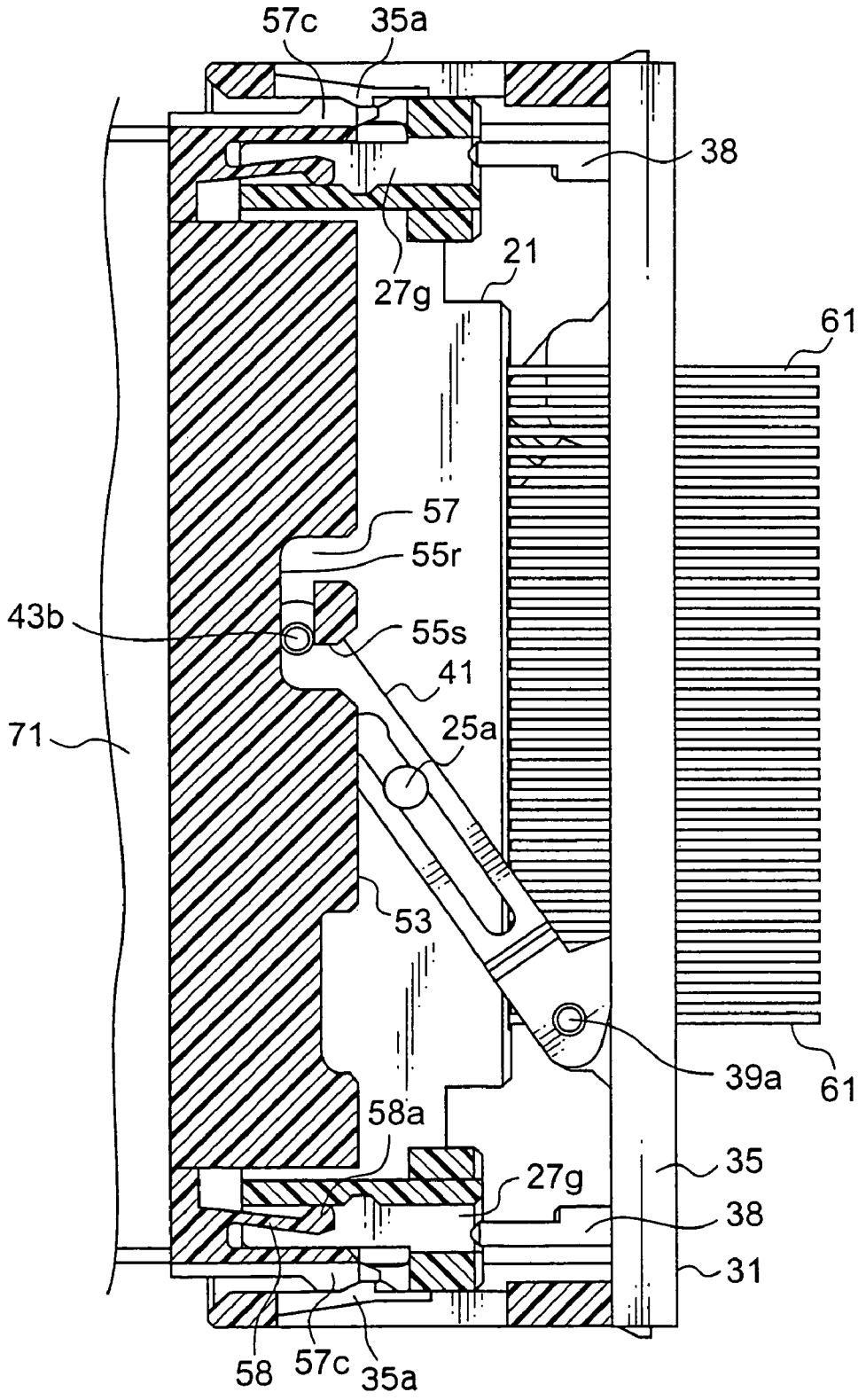
FIG. 40 is a sectional side view of the connector apparatus in FIG. 1 in a third state during connection.
Figure 41:
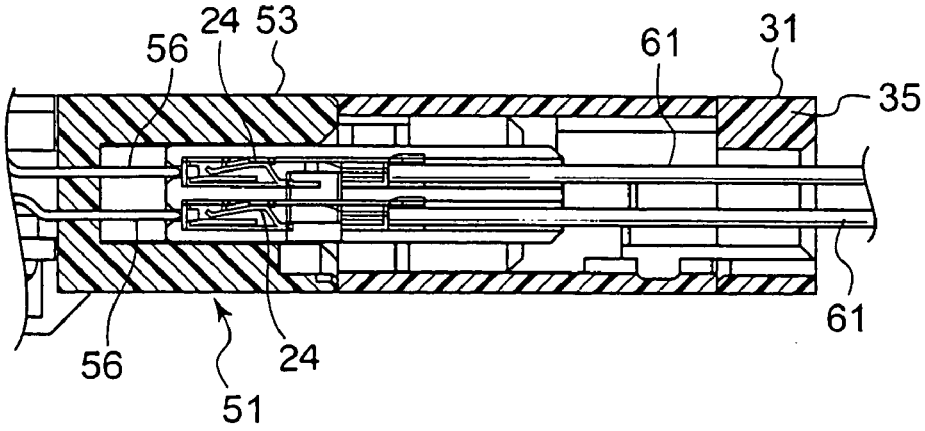
FIG. 41 is a sectional plan view of the connector apparatus in FIG. 40.
Figure 42:
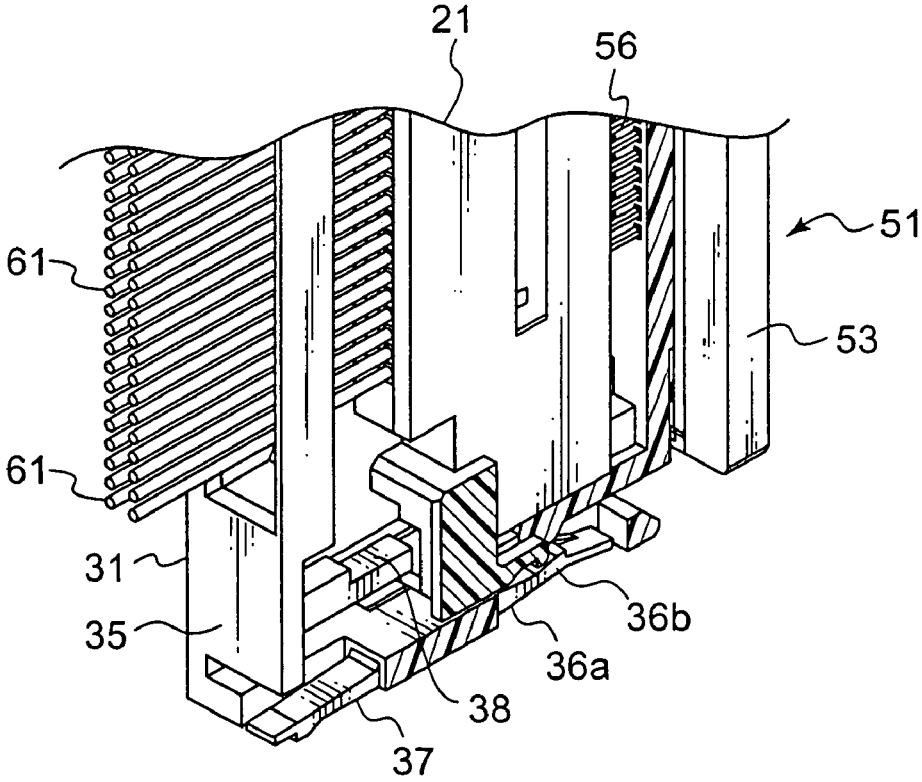
FIG. 42 is an enlarged sectional perspective view of a part of the connector apparatus in FIG. 40.
Figure 43:
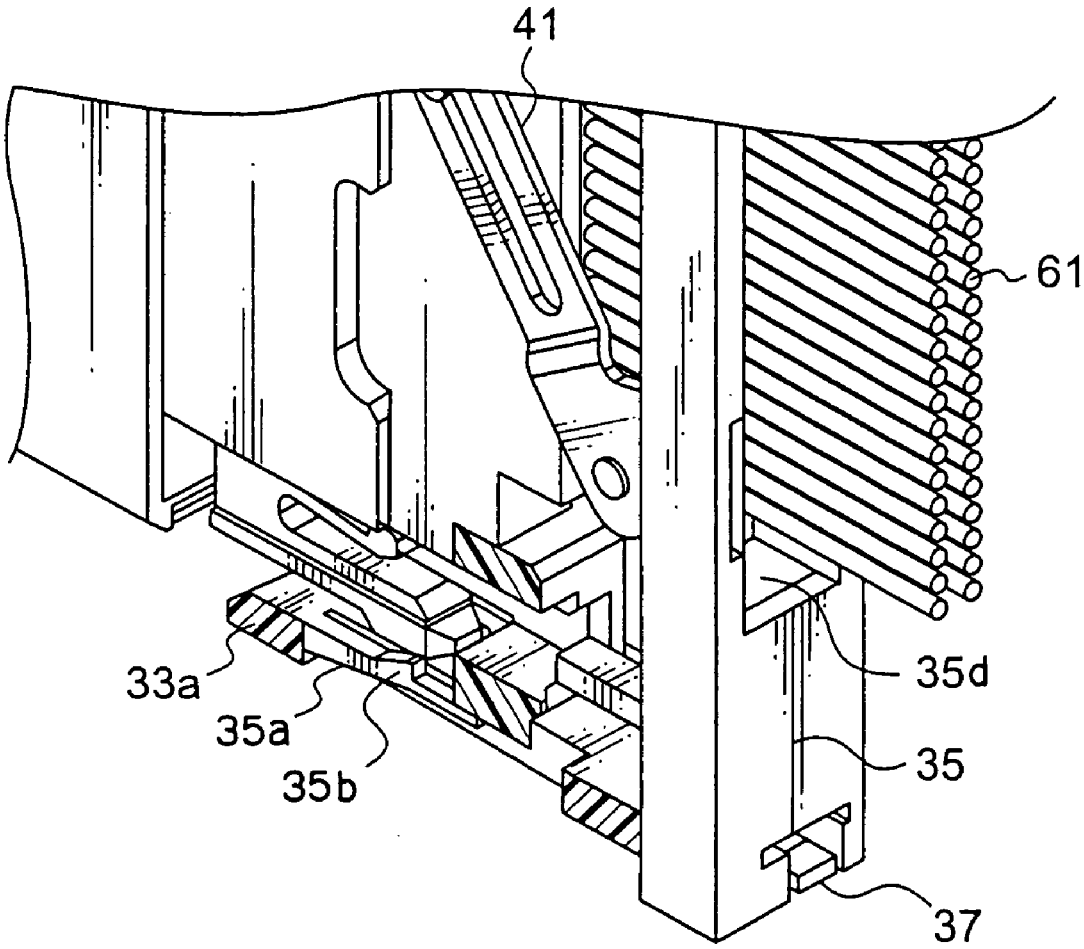
FIG. 43 is an enlarged sectional perspective view similar to FIG. 42 as seen in a different direction.
Figure 44:
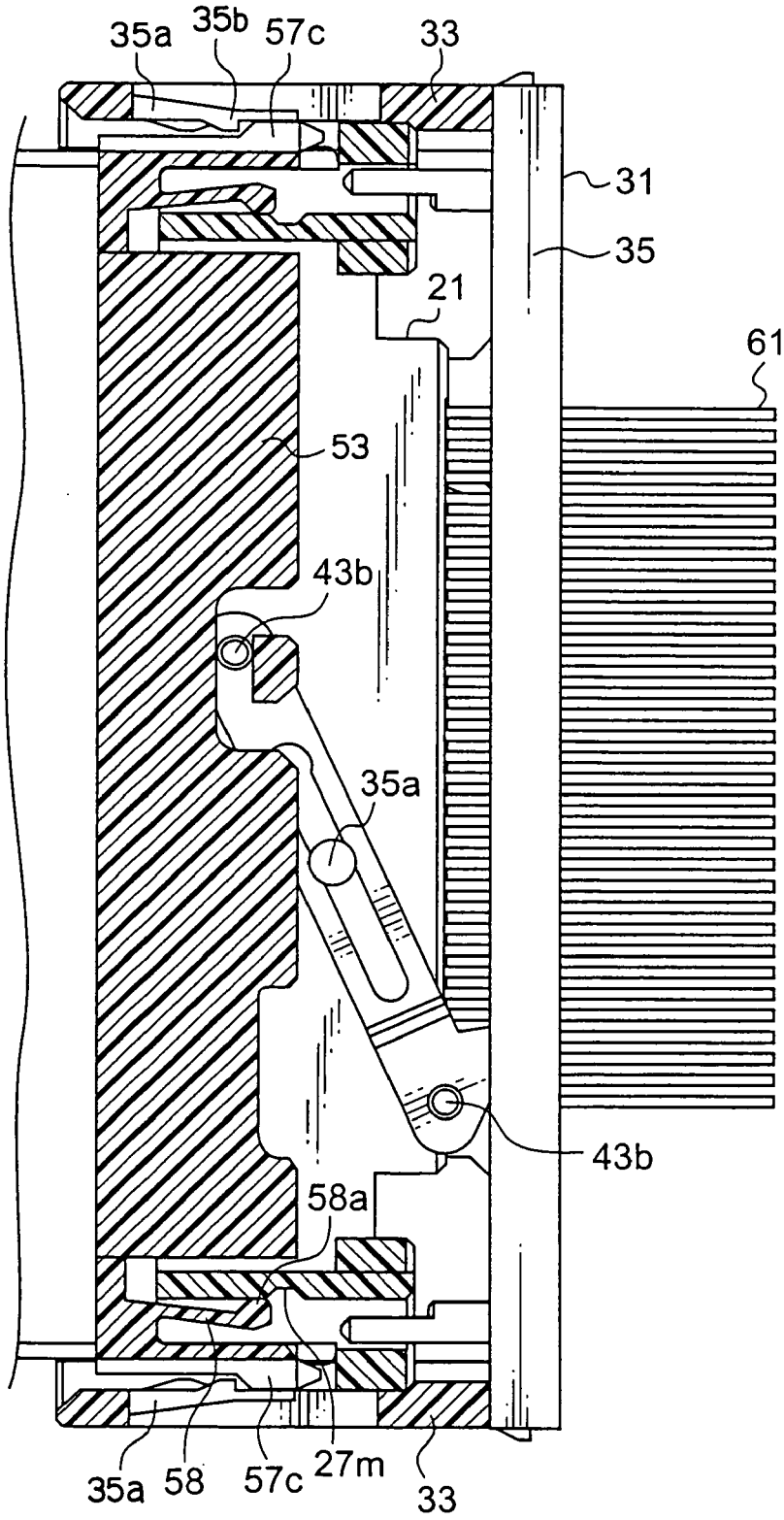
FIG. 44 is a sectional side view of the connector apparatus in FIG. 1 in a fourth state during connection.
Figure 45:
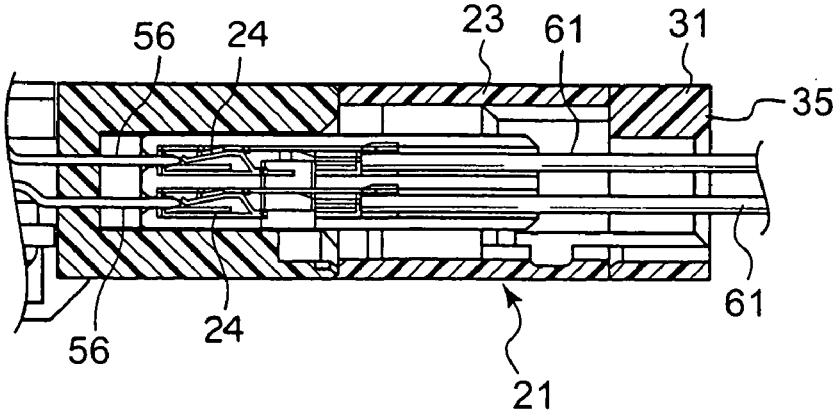
FIG. 45 is a sectional plan view of the connector apparatus in FIG. 44.
Figure 46:
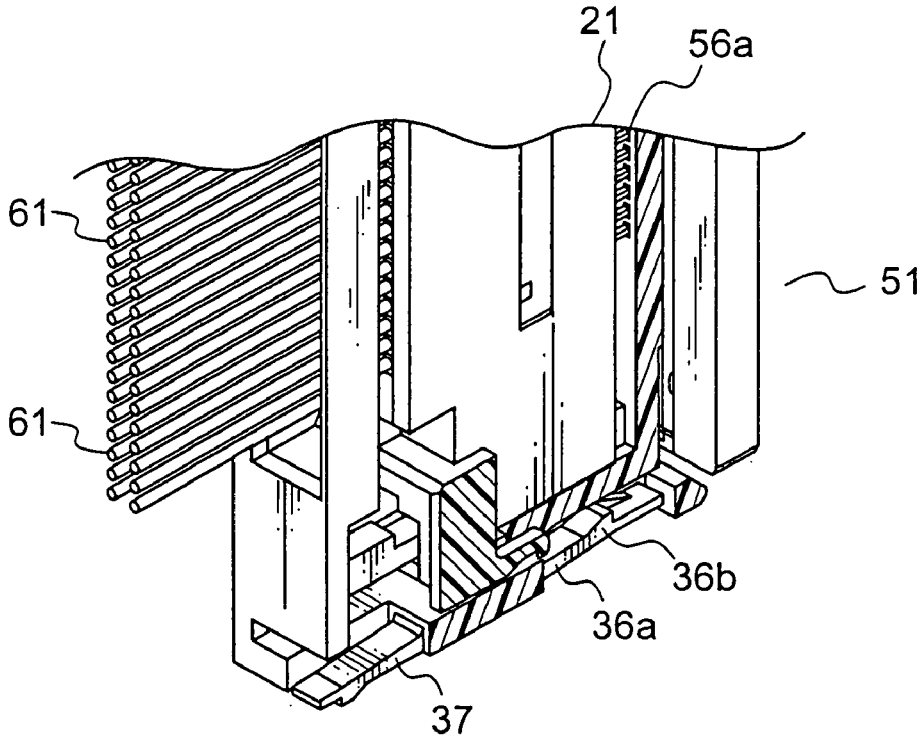
FIG. 46 is an enlarged sectional perspective view of a part of the connector apparatus in FIG. 44.
Figure 47:
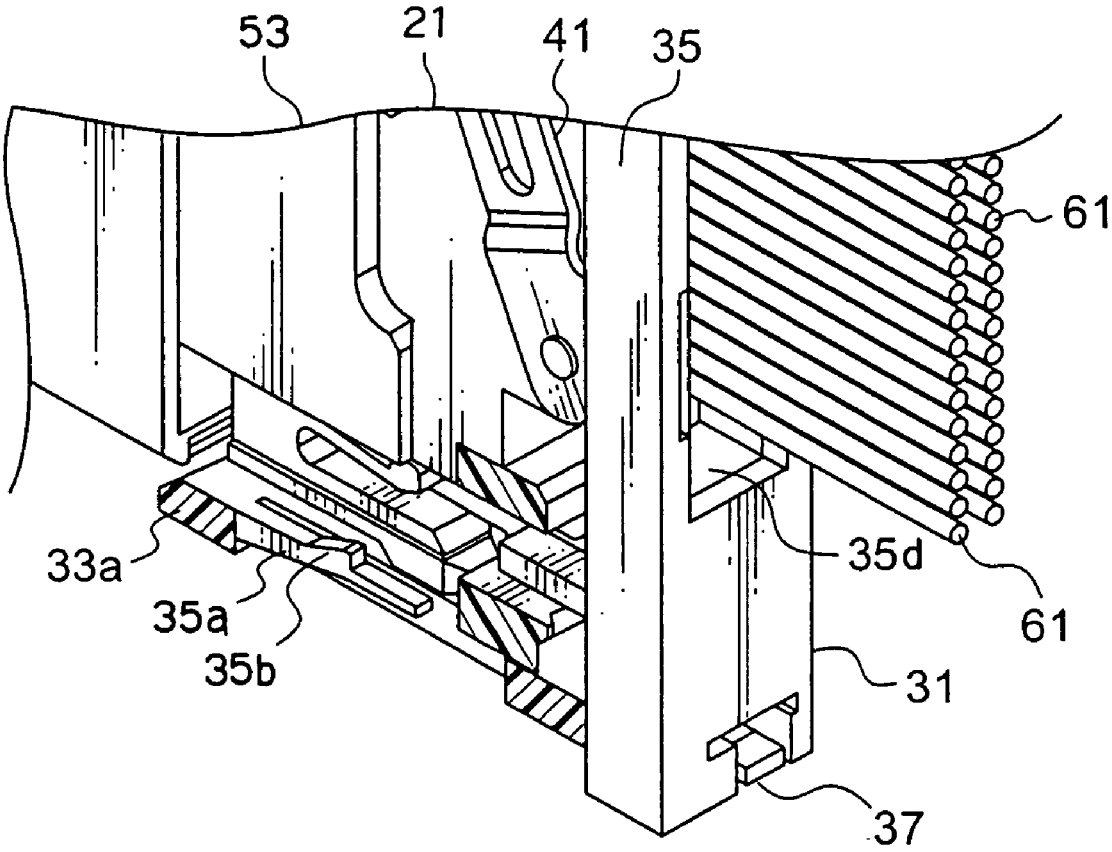
FIG. 47 is an enlarged sectional perspective view similar to FIG. 46 as seen in a different direction.
Figure 48:
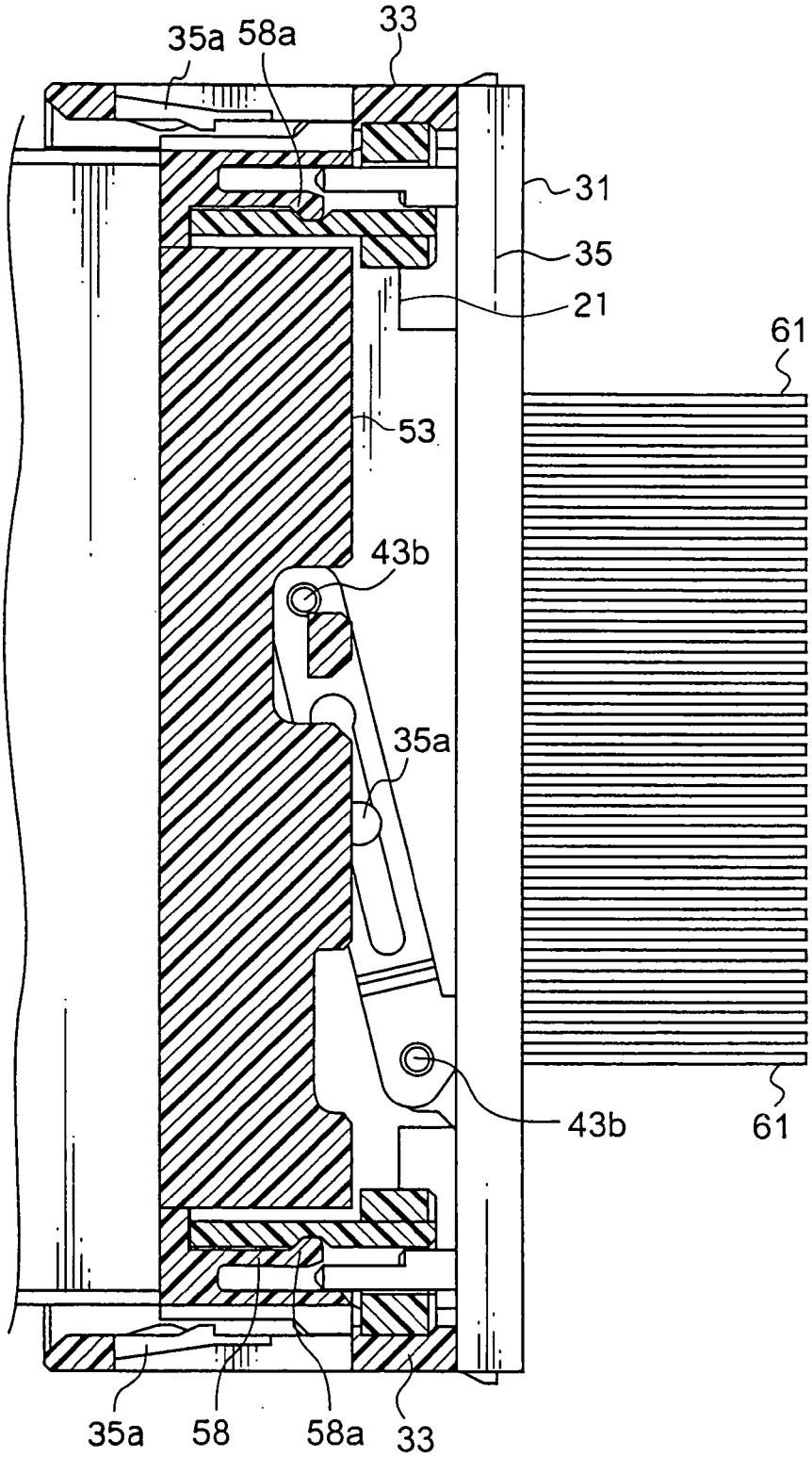
FIG. 48 is a sectional side view of the connector apparatus in FIG. 1 in a fifth state during connection.
Figure 49:
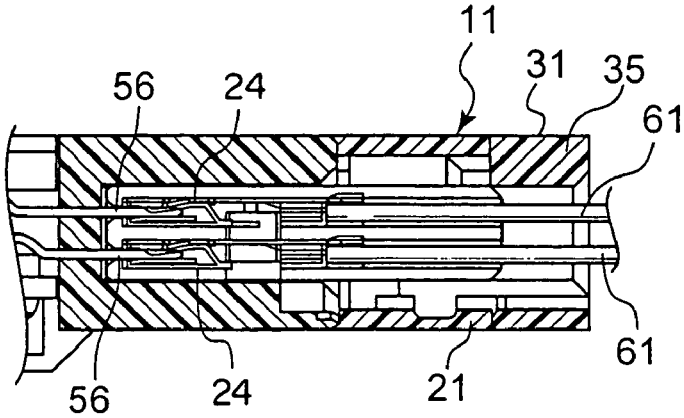
FIG. 49 is a sectional plan view of the connector apparatus in FIG. 48.
Figure 50:
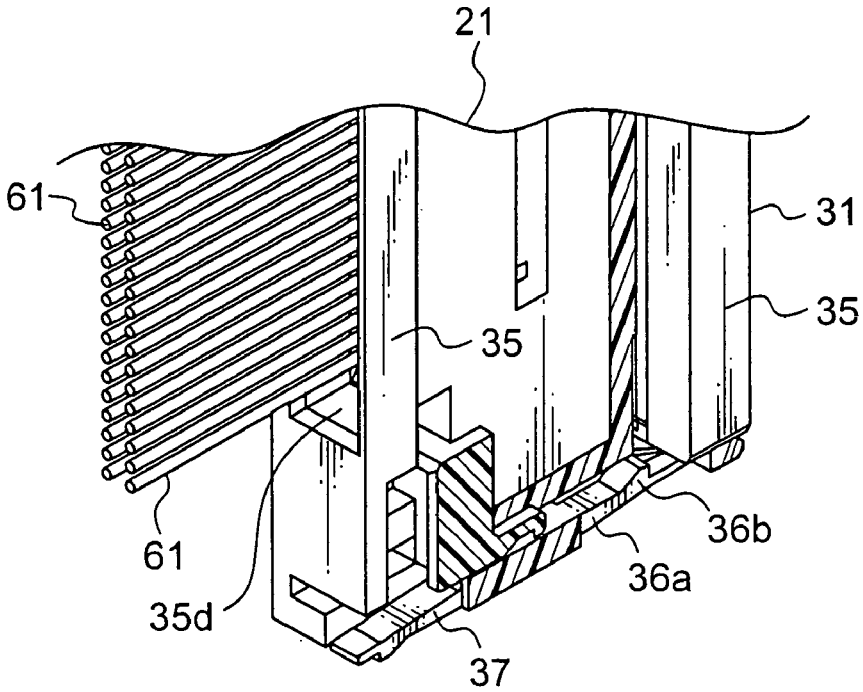
FIG. 50 is an enlarged sectional perspective view of a part of the connector apparatus in FIG. 48.
Figure 51:
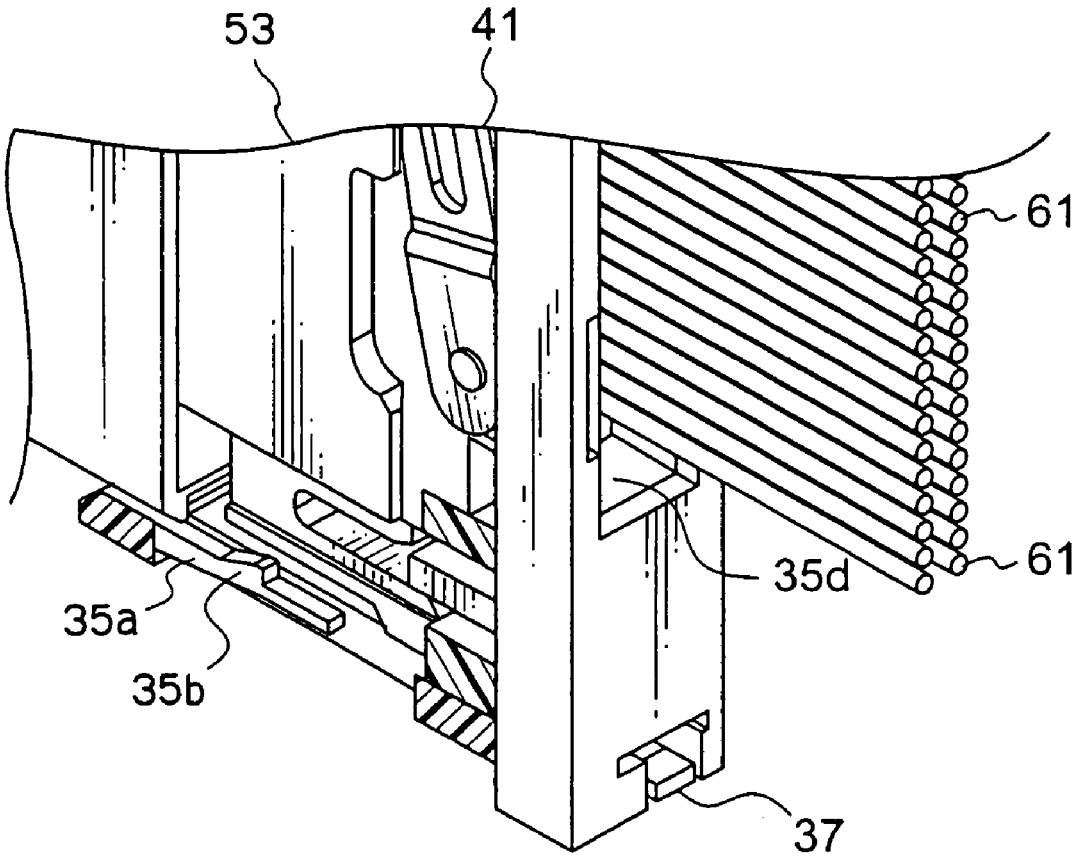
FIG. 51 is an enlarged sectional perspective view similar to FIG. 50 as seen in a different direction.
Figure 52:
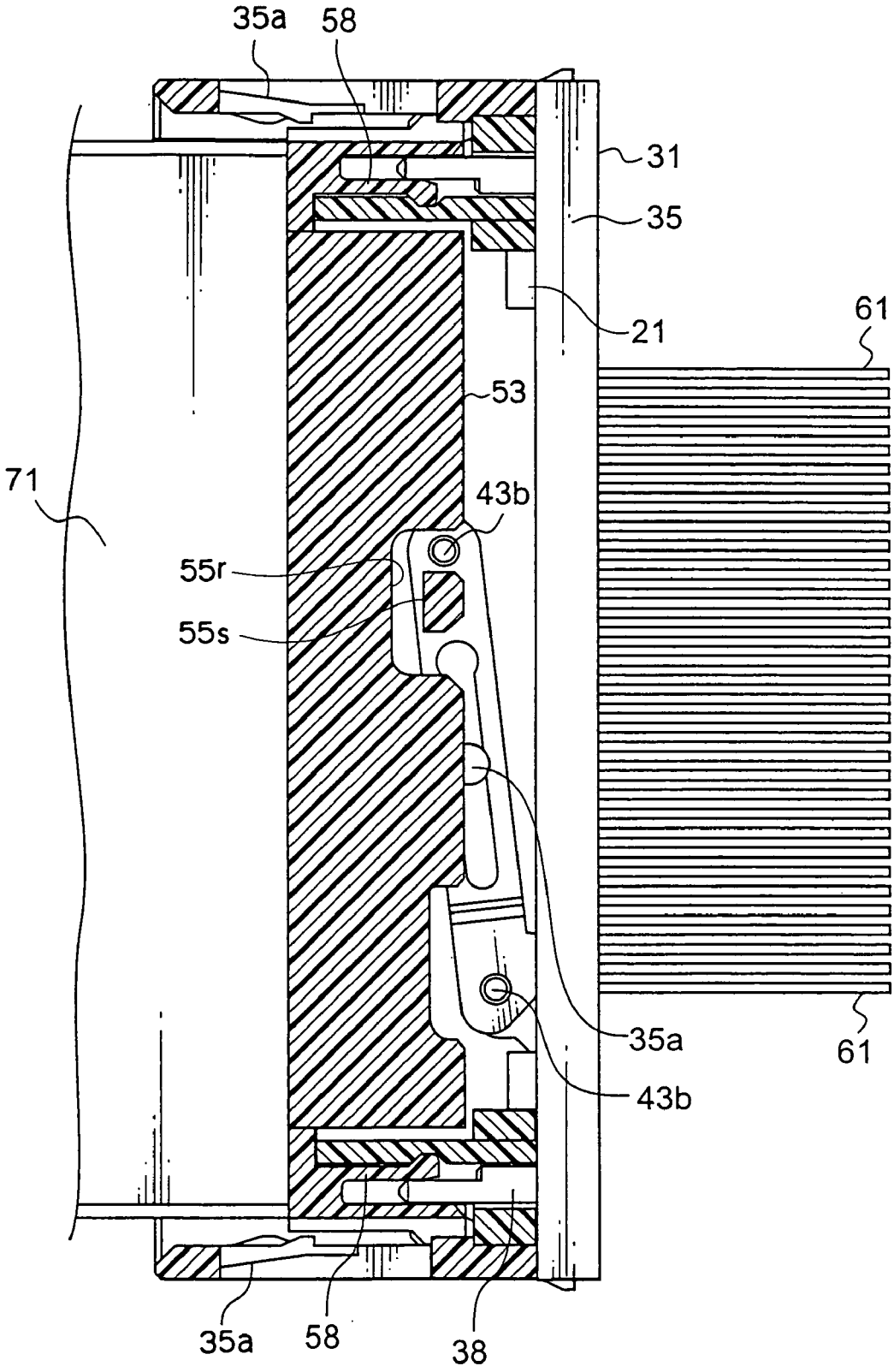
FIG. 52 is a sectional side view of the connector apparatus in FIG. 1 in a state during floating after completion of connection.
Figure 53:
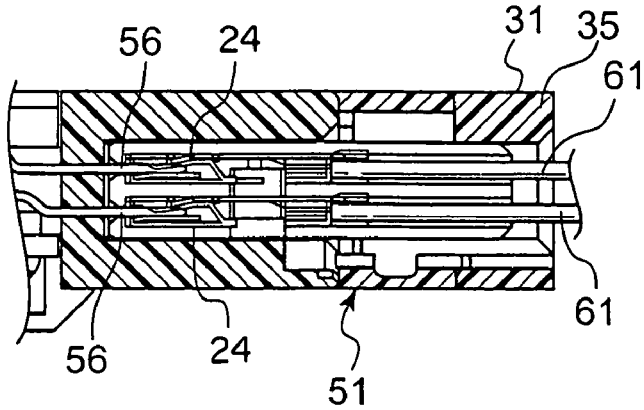
FIG. 53 is a sectional plan view of the connector apparatus in FIG. 52.
Figure 54:
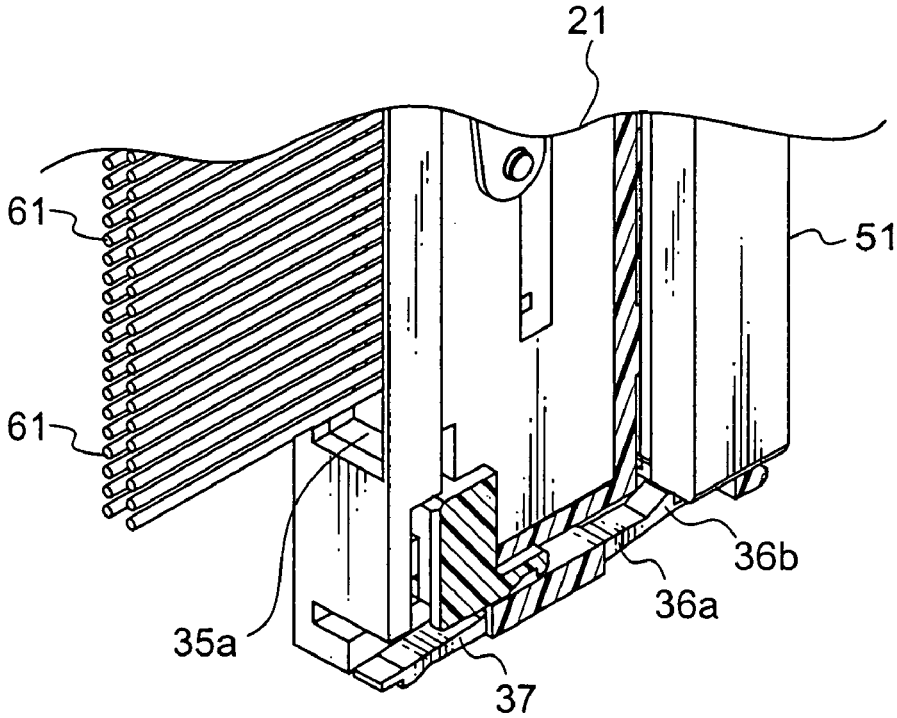
FIG. 54 is an enlarged sectional perspective view of a part of the connector apparatus in FIG. 52.
Figure 55:
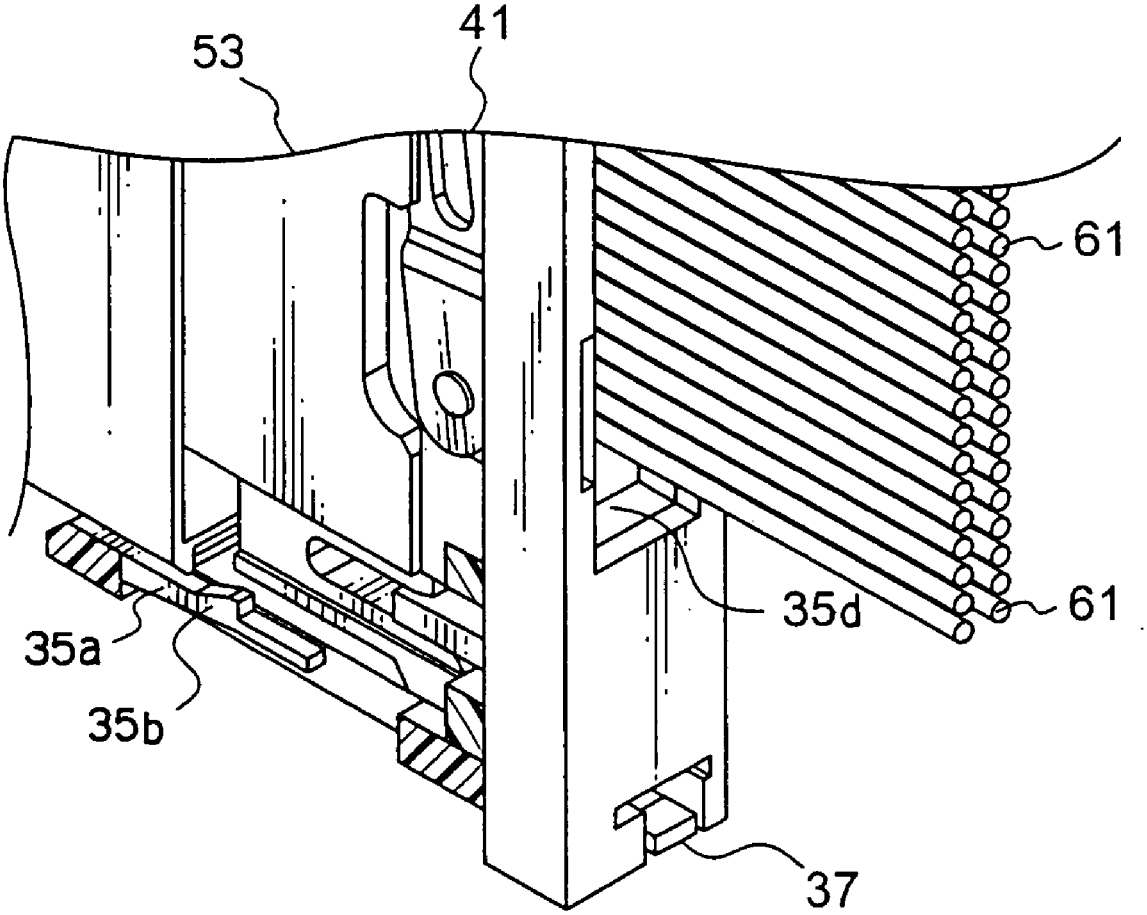
FIG. 55 is an enlarged sectional perspective view similar to FIG. 54 as seen in a different direction.
Figure 56:
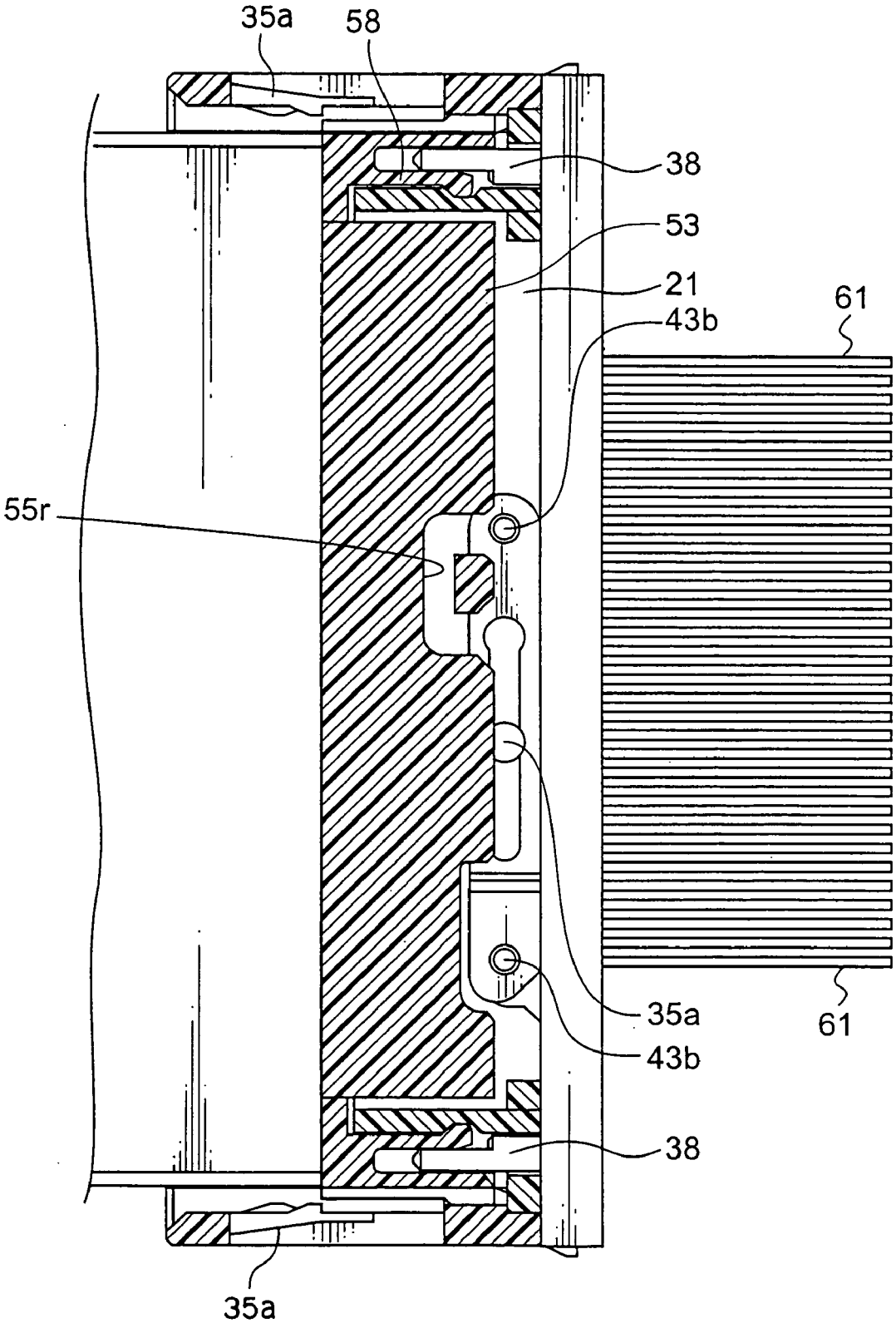
FIG. 56 is a sectional side view of the connector apparatus in FIG. 1 in a state after completion of floating.
Figure 57:
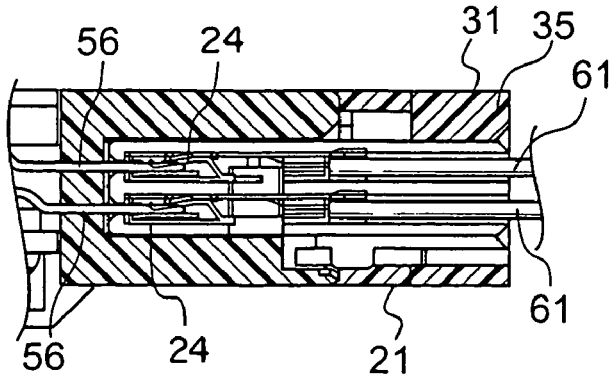
FIG. 57 is a sectional plan view of the connector apparatus in FIG. 56.
Figure 58:
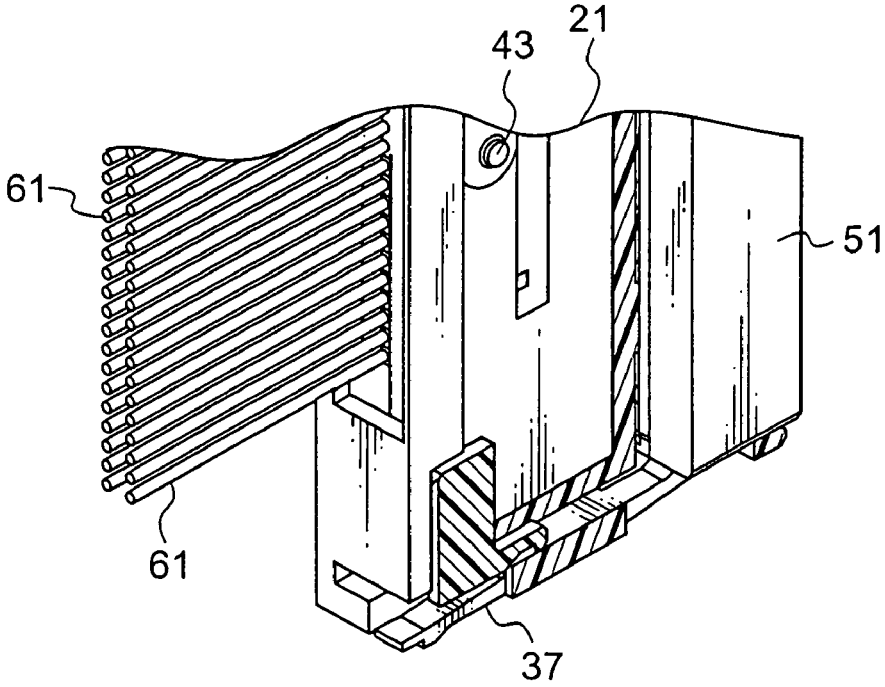
FIG. 58 is an enlarged sectional perspective view of a part of the connector apparatus in FIG. 56.

As shown in FIGS. 24 through 26 also, the housing 53 has a fitting portion 55*a* formed on one side perpendicular to a longitudinal direction of the housing 53, a pair of guide portions 57*c* formed on longitudinal opposite sides of the housing 53, a top plate portion 55*f*, a bottom plate portion 55*g* faced to the top plate portion 55*f*, and a pair of second cam-operated portions 57 in the shape of grooves formed on the top and the bottom plate portions 55*f* and 55*g*, respectively. Each of the second cam-operated portions 57 is a generally U-shaped groove opened at opposite ends.

The housing 53 has a pair of lock spring portions 58 formed in the fitting portion 55*a* at longitudinal opposite sides of the housing 53, a pair of fixing portions 59 mounted to the circuit board 81 in the unit 71, and a receiving portion 55*b* formed in the fitting portion 55*a* to receive the contacts 56.

The fitting portion 55*a* has a fitting wall portion 55*c* provided with a plurality of insertion holes 55*m* holding the contacts 56 inserted therethrough. Between the fixing portions 59, a locator 60 is arranged.

The fitting portion 55*a* is fitted to the fitting portion 23*b* of the first connector 11. The guide portions 57*c* are inserted inside the frame portions 33 of the base member 31 upon fitting.

The second cam-operated portions 57 are formed on the top and the bottom plate portions 55*f* and 55*g* at positions offset from each other in the longitudinal direction. The second cam-operated portions 57 are generally U-shaped grooves formed from one sides of the top and the bottom plate portions 55*f* and 55*g* as fitting sides and are engaged with and interferes with the second cam portions 43*b* of the lever members 41 to serve as interfering grooves. The second cam-operated portions 57 have side wall surfaces 55*r* and 55*s* as thickened portions of the top and the bottom plate portions 55*f* and 55*g*.

The lock spring portions 58 extend from a rear wall portion 55*x* of the housing 53 towards the fitting portion 55*a*. Each of the lock spring portions 58 has a protruding portion 58*a* formed at its end. The protruding portions 58*a* are fitted to the recesses 27*m* of the housing 21 of the first connector 11 upon fitting. Each of the fixing portions 59 has a screw hole 59*a* to be fixed by a screw in order to mount the second connector 51 to the circuit board 81 in the unit 71.

Each of the contacts 56 has a contacting portion 56*a* positioned at the fitting portion 55*a*, a holding portion 56*b* held by the rear wall portion 55*x* of the housing 53, and a terminal portion 56*c* extending outward from the holding portion 56*b*.

The locator 60 serves to align the terminal portions 56*c* of the contacts 56 and to insert the terminal portions 56*c* into through holes of the circuit board 81. The terminal portions 56*c* are connected to the circuit board 81 by soldering.

In order to connect the first and the second connectors 11 and 51 to each other, the first cam portions 43*a* of the lever members 41 and the first cam-operated portions 25*a* and 25*b* of the first connector 11 cooperate with each other while the second cam portions 43*b* of the lever members 41 and the second cam-operated portions 57 of the housing 53 cooperate with each other. As a result, the lever members 41 are rotated so that the first and the second connectors 11 and 51 are connected to each other, as will presently be described in detail.

Now, description will be made of a fitting process of the first and the second connectors 11 and 51, i.e., a connecting process of the connector apparatus illustrated in FIGS. 1 and 2.

In a state before fitting (before connection) illustrated in FIGS. 27 to 30, the housing 21 of the first connector 11 is inserted between the frame portions 33 of the base member 31 in the fitting direction A to be integrally fixed to the base member 31. The first positioning portions 27*a* of the housing 21 are engaged with the first engaging portions 35*b* of the first positioning spring portions 35*a* of the base member 31. The claw portions 28*a* of the second positioning portions 28 of the housing 21 are engaged with the second engaging portions 36*b* of the second positioning spring portions 36*a* of the base member 31. In the state illustrated in FIGS. 27 to 30, it is noted that the lock bar portions 38 of the base member 31 are not inserted into the through holes 27*g* of the housing 21 and that the lever members 41 do not protrude outward from the fitting surface 23*c* of the first connector 11.

In a first state during fitting (during connection) illustrated in FIGS. 31 to 34, the guide portions 57*c* of the housing 53 of the second connector 51 are slightly inserted between the frame portions 33 of the base member 31 of the first connector 11. At the start of fitting, the protruding portions 58*a* of the lock spring portions 58 of the housing 53 are pushed by the wall surfaces 27*j* of the through holes 27*g* of the housing 21 to be bent and displaced during movement in the fitting direction A. As a result, an arc-shaped side 41*f* of each lever member 41 near the second cam portion 43*b* is moved to the vicinity of an inclined wall surface 55*t* formed at an inlet of the second cam-operated portion 57 of the housing 53.

As shown in FIGS. 35 to 39, in a second state during fitting (during connection) in which a fitting operation progresses from the first state, the guide portions 57*c* of the housing 53 of the second connector 51 push outward and displace the second positioning spring portions 36*a* of the base member 31 of the first connector 11. At this time, the housing 21 is allowed to be moved in the fitting direction A and, simultaneously, the lever members 41 are rotatable around the bearing portions 39*a* of the base member 31. In this state, the arc-shaped side 41*f* of each lever member 41 near the second cam portion 43*b* moves to the vicinity of the side wall surface 55*r* at an inner part of the second cam-operated portion 57 of the housing 53. As a consequence, the second cam portion 43*b* is inserted between the side wall surfaces 55*r* and 55*s* at the inner part of the second cam-operated portion 57.

As shown in FIGS. 40 to 43, in a third state during fitting (during connection) in which the fitting operation further progresses from the second state, the second connector 51 is closer to the first connector 11. As a consequence, the second cam portion 43*b* of each lever member 41 starts to interfere with the side wall surfaces 55*r* and 55*s* between the side wall surfaces 55*r* and 55*s* of the second cam-operated portion 57 of the housing 53.

As shown in FIGS. 44 to 47, in a fourth state during fitting (during connection) in which the fitting operation still further progresses, movement of the housing 21 and rotation of each lever member 11 are progressing. At this time, the contacts 24 of the first connector 11 and the contacts 56 of the second connector 51 start to be brought into contact with each other.

As illustrated in FIGS. 48 to 51, in a fifth state during fitting (during connection) in which the fitting operation still further progresses, movement of the housing 21 and rotation of each lever member 41 further progress and the contacts 24 and the contacts 56 are completely brought into contact with each other. At this time, the lock spring portions 58 of the housing 53 of the second connector 51 are inserted into the through holes 27*g* of the housing 21 of the first connector 11. The protruding portions 58*a* of the lock spring portions 58 are engaged with the recesses 27*m* of the housing 21. The protruding portions 58*a* of the lock spring portions 58 of the housing 53 are engaged with the recesses 27*m* of the housing 21 simultaneously with completion of the fitting operation. The second cam portion 43*b* of each lever member 41 interferes with the side wall surface 55*s* of the second cam-operated portion 57 of the housing 53 so as to reduce an insertion force.

As illustrated in FIGS. 52 to 55, after completion of the fitting operation of the first and the second connectors 11 and 51, floating between the first and the second connectors 11 and 51 is started. After start of floating, no interference is present between the second cam portion 43*b* of each lever member 41 and the side wall surfaces 55*r* and 55*s* of the second cam-operated portion 57 of the housing 53. However, the lock bar portions 38 of the base member 31 are positioned outside the lock spring portions 58 of the housing 53 so that the lock spring portions 58 are prevented from being displaced. Therefore, the first and the second connectors 11 and 51 are prevented from being separated from each other.

FIGS. 56 to 59 show a state of maximum displacement upon floating. By such floating, it is possible to absorb assembling errors of various components in the fitting direction A and the separating direction B.

After completion of fitting of the first and the second connectors 11 and 51, the fitted state is locked by the lock spring portions 58. During floating, the lock bar portions 38 of the base member 31 make it possible to prevent the fitted state from being unlocked.

Figure 60:
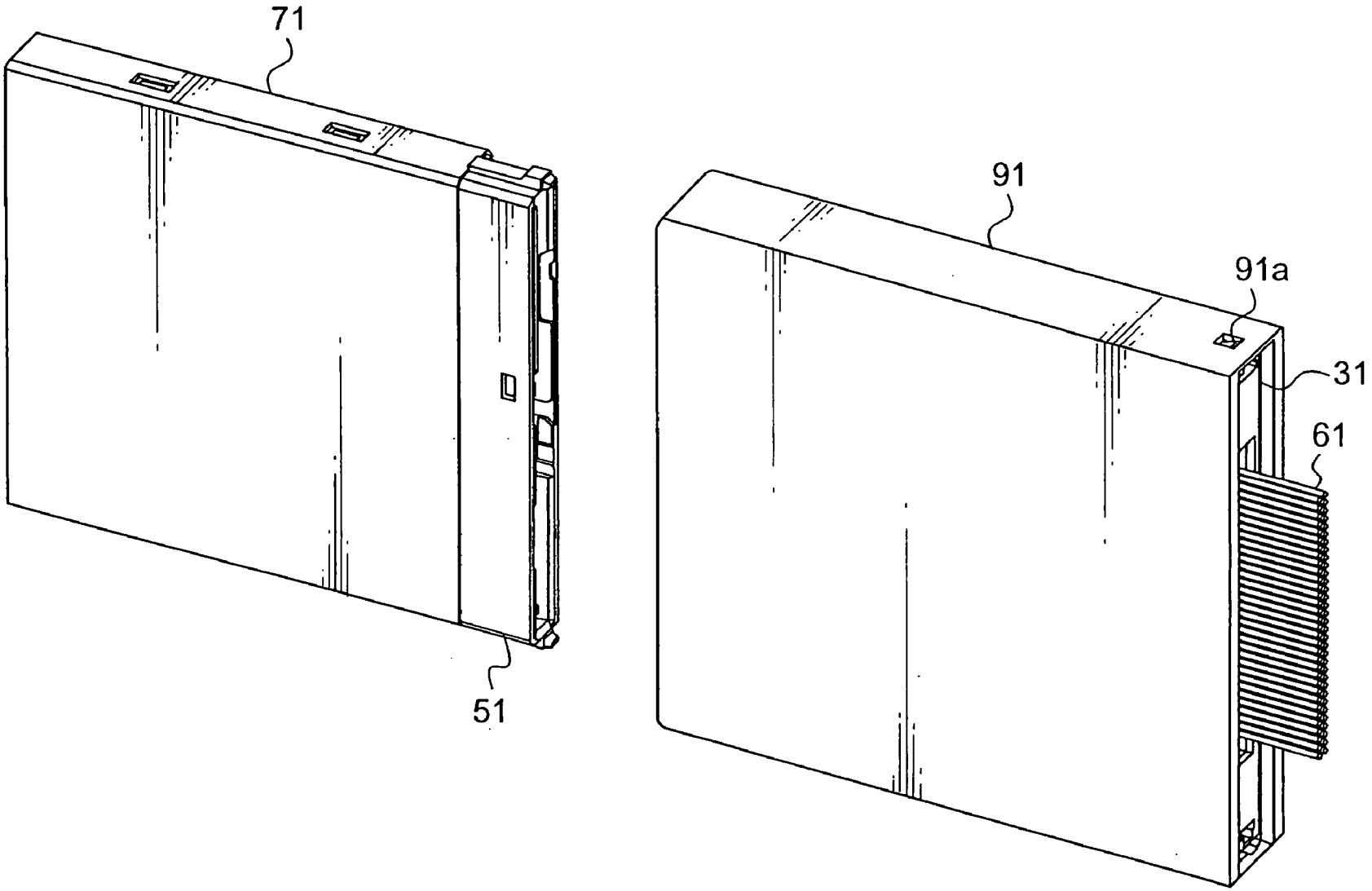
FIG. 60 is a perspective view of a connector apparatus according to a second embodiment of this invention in a state before connection, the connector apparatus including a first connector with cables connected thereto and a second connector adapted to be fitted to the first connector.
Figure 61:
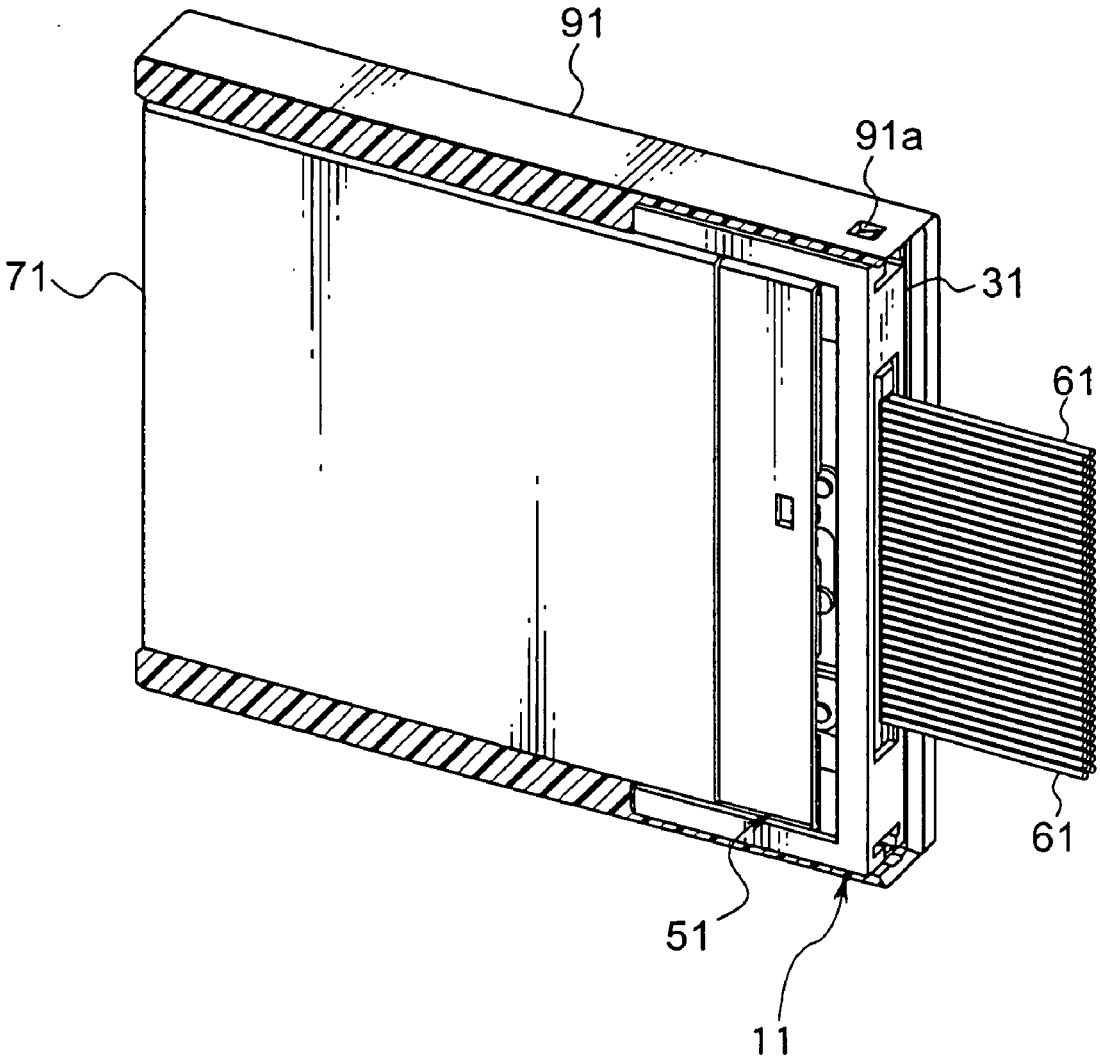
FIG. 61 is a sectional perspective view of the connector apparatus in FIG. 60 in a state after connection.
Figure 62:
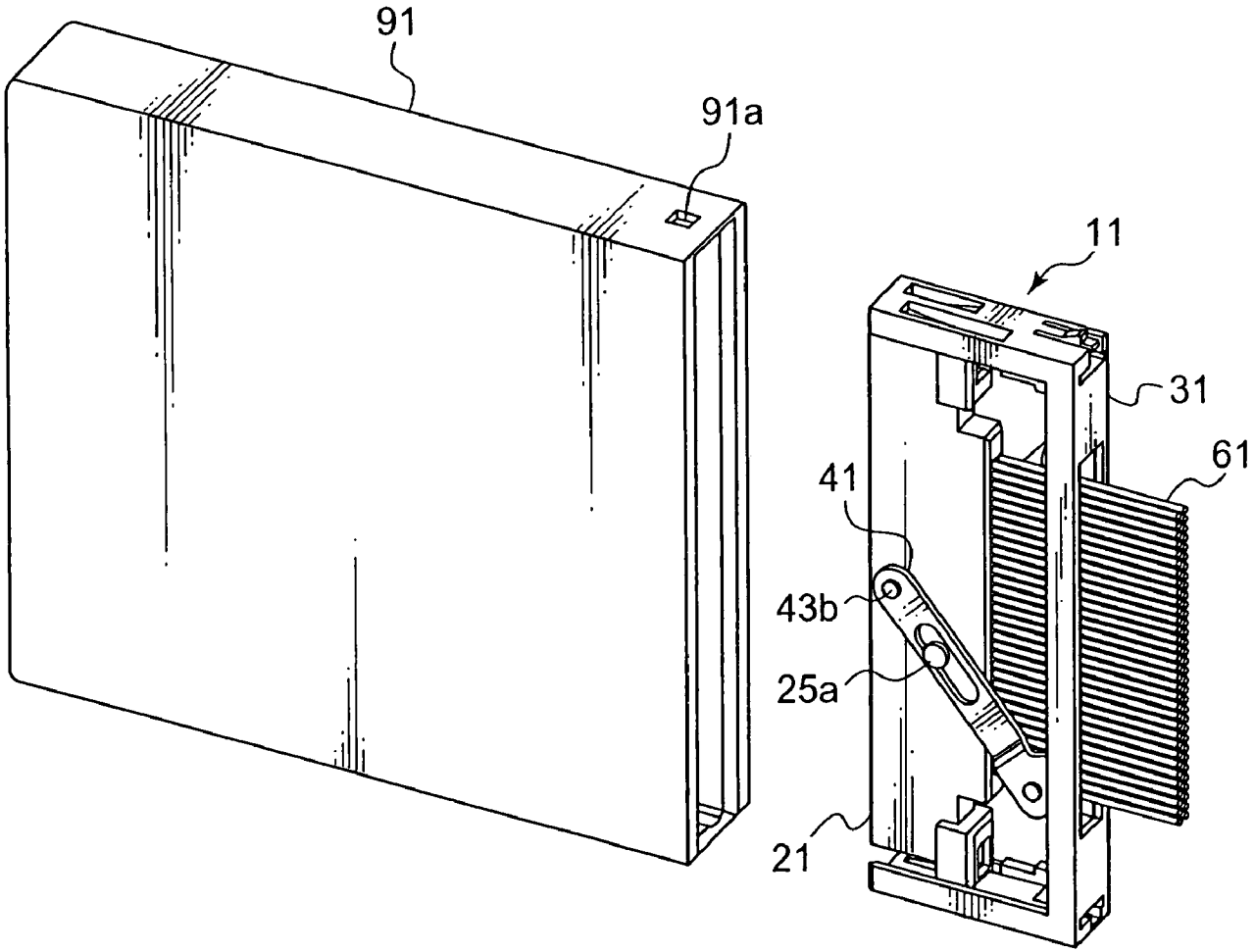
FIG. 62 is an exploded perspective view of the first connector in FIG. 60.

Referring to FIGS. 60 to 62, description will be made of a connector apparatus according to a second embodiment of this invention. Similar parts are designated by like reference numerals and description thereof will be omitted.

In addition to the first connector 11 with the base member 31 attached thereto, the unit 71, and the second connector 51, the connector apparatus comprises the module 91 which houses the above-mentioned components. The fixed spring portions 37 of the base member 31 are engaged with locking holes 91*a* formed on the module 91 so that the first connector 11 and the module 91 are coupled. The second connector 51 with the unit 71 attached thereto in a state before fitting as illustrated in FIG. 60 is fitted to the module 91 as shown in FIG. 61. Specifically, in a state where the base member 31 is inserted into the module 91, the second connector 51 and the unit 71 are inserted into the module 91. Thus, the first and the second connectors 11 and 51 are fitted to each other.

Although this invention has been described in conjunction with a few preferred embodiments thereof, this invention may be modified in various other manners within the scope of the appended claims. Although two lever members are used in the above-mentioned connector apparatus, the number of the lever members may be one or 3 or more. The second connector may be stationary while the first connector is movable. It is a matter of course that the first and second connectors may relatively be movable.

What is claimed is:

1. A connector apparatus comprising a first and a second connector which are adapted to be connected to each other with relative movement in a fitting direction and to be disconnected from each other with relative movement in a separating direction opposite to the fitting direction, wherein:

the first connector comprises:

a base member;

a housing held by the base member to be movable in the fitting direction and in the separating direction; and a lever member coupled to the base member and the housing;

the lever member comprising:

an axis portion rotatably supported by the base member;

a first cam portion spaced from the axis portion and faced to the housing; and a second cam portion formed at a rotating end;

the housing having a first cam-operated portion which is cooperated with the first cam portion to rotate the lever member with respect to the axis portion following the movement of the housing;

the second connector having a second cam-operated portion which is adapted to be engaged with the second cam portion in the separating direction;

the second cam-operated portion being engaged with and separated from the second cam portion following the rotation of the lever member.

2. The connector apparatus according to claim 1, wherein, when the first and the second connectors are relatively moved in the fitting direction, the first cam portion and the second cam portion are cooperated with the first cam-operated portion and the second cam-operated portion, respectively, to connect the first and the second connectors to each other with making the lever member be rotated with respect to the axis portion.

3. The connector apparatus according to claim 1, wherein the base member comprises:

a frame portion extending in the fitting direction and in the separating direction;

a base portion connected to the frame portion;

a first positioning spring portion connected to the frame portion and extending in the fitting direction to position the housing; and a second positioning spring portion connected to the frame portion and extending from an intermediate portion of the housing towards an end of the housing.

4. The connector apparatus according to claim 3, wherein the first positioning spring portion has a first engaging portion formed at its intermediate portion to be engaged with the housing, the second positioning spring portion having a second engaging portion formed at its intermediate portion to be engaged with the housing.

5. The connector apparatus according to claim 1, wherein:

the housing has a through hole;

the base portion having:

a lock bar portion received in the through hole; and a bearing plate portion having a bearing portion for receiving the axis portion.

6. The connector apparatus according to claim 5, wherein the second connector comprises:

a fitting portion to be fitted to the first connector; and a lock spring portion movable in the fitting direction to be locked to the housing in a state where the lock spring portion is pushed by a wall surface of the through hole to be bent and displaced;

the wall surface of the through hole being provided with a recess;

the lock spring portion having a protrusion to be engaged with the recess.

7. The connector apparatus according to claim 5, wherein the lever member comprises:

a first lever plate portion having a first cam portion; and a second lever plate portion connected to one end of the first lever plate portion;

the second cam portion protruding on one surface of the first lever plate portion at the other end of the first lever plate portion;

the second lever plate portion being provided with the axis portion.

8. The connector apparatus according to claim 1, wherein the second cam-operated portion having:

a top plate portion; and a bottom plate portion faced to the top plate portion;

at least one of the top and the bottom plate portions being provided with the second cam-operated portion in the shape of a groove to be engaged with and interfere with the second cam portion.

9. The connector apparatus according to claim 1, wherein one of the first cam portion and the first cam-operated portion is a long hole extending obliquely with respect to the fitting direction and the separating direction, the other of the first cam portion and the first cam-operated portion is a protrusion inserted into the long hole.

10. The connector apparatus according to claim 9, wherein one of the second cam portion and the second cam-operated portion comprises a groove portion having a wall surface extending in a direction intersecting the fitting direction and the separating direction, the other of the second cam portion and the second cam-operated portion being a protrusion inserted into the groove portion following movement of the first and the second connectors towards each other.

11. The connector apparatus according to claim 10, wherein the groove portion is a generally U-shaped groove having opposite open ends opened on a surface facing the first connector, the protrusion passing the groove portion following movement of the first and the second connectors towards each other and rotation of the lever member.

* * * * *